US011267533B1

(12) United States Patent
Dery St-Cyr et al.

(10) Patent No.: US 11,267,533 B1
(45) Date of Patent: Mar. 8, 2022

(54) MOORING LINE ASSEMBLY FOR A WATERCRAFT

(71) Applicant: BOMBARDIER RECREATIONAL PRODUCTS INC., Valcourt (CA)

(72) Inventors: Karl Dery St-Cyr, St-Denis-de-Brompton (CA); Mathieu Mercier, Sherbrooke (CA); Mohammad Moeini, Montreal (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 15 days.

(21) Appl. No.: 16/887,606

(22) Filed: May 29, 2020

Related U.S. Application Data

(60) Provisional application No. 62/853,858, filed on May 29, 2019.

(51) Int. Cl.
*B63B 21/04* (2006.01)
*B63B 34/10* (2020.01)

(52) U.S. Cl.
CPC ..... *B63B 21/04* (2013.01); *B63B 34/10* (2020.02)

(58) Field of Classification Search
CPC ..... B63B 21/04; B63B 34/10
See application file for complete search history.

(56) References Cited

U.S. PATENT DOCUMENTS

| | | | | |
|---|---|---|---|---|
| 9,694,878 | B2 * | 7/2017 | Johnston | B63B 21/20 |
| 2012/0188696 | A1 * | 7/2012 | Gildseth | B63B 21/22 361/679.01 |
| 2015/0090173 | A1 * | 4/2015 | Naess | B63B 35/44 114/266 |
| 2015/0314833 | A1 * | 11/2015 | Betcher | B63B 22/02 405/224.1 |

OTHER PUBLICATIONS

Speed Ties For all Sea-Doo watercraft. Datasheet [online], BRP, 2003-2020 [retrieved on May 29, 2020]. Retrieved from the Internet: <URL: https://www.sea-doo.com/us/en/shop/accessories/docking/speed_ties.html>.

Retractable Mooring Line. Datasheet [online]. BOT ROP, [retrieved on May 29, 2020], Retrieved from the Internet <URL: https://https://www boat-rope com/>.

* cited by examiner

*Primary Examiner* — S. Joseph Morano
*Assistant Examiner* — Jovon E Hayes
(74) *Attorney, Agent, or Firm* — BCF LLP

(57) ABSTRACT

A mooring line assembly for a watercraft has an elastic line having a first end and a second end, the first end of the elastic line being adapted for connection to the watercraft, a mooring line having a first end and a second end, the first end of the mooring line being connected to the second end of the elastic line, and a housing adapted for connection to the watercraft. The mooring line extends through the housing and is pullable therethrough from a retracted position to a plurality of extended positions. The elastic line is adapted for returning the mooring line to the retracted position from the plurality of extended positions. A watercraft provided with the mooring line assembly is also disclosed.

20 Claims, 26 Drawing Sheets

MOORING LINE ASSEMBLY FOR A WATERCRAFT

CROSS-REFERENCE

The present application claims priority to U.S. Provisional Patent Application No. 62/853,858, filed May 29, 2019, the entirety of which is incorporated herein by reference.

TECHNICAL FIELD

The present technology relates to mooring line assemblies for watercraft.

BACKGROUND

Mooring lines are typically used to secure a watercraft to a mooring such as a dock. The mooring lines are connected between cleats or other structures provided on the watercraft and on the mooring. However, storage of the mooring lines when not in use can be inconvenient. Also, if the unused mooring lines are not properly wound and stored, it can lead to knots forming in the mooring lines.

One solution to these problems is to provide a retractable mooring line assembly. Some versions of these include a spring-loaded spool around which the mooring line is wound. A ratcheting mechanism, or other mechanism, allows a desired length of mooring line to be unwound and used to secure the watercraft to the mooring.

Although retractable mooring line assemblies of the type described above address the above-mentioned problems, they also have certain inconveniences. Depending on the type of mooring line being used, the mooring line can swell when wet, which can jam the mechanism of the retractable mooring line assembly. Such retractable mooring line assemblies can also be bulky, which can make them difficult to provide at a convenient location for such an assembly on a small watercraft such as a personal watercraft.

One solution to the bulk issue associated with the type of retractable mooring line assemblies described above is to reduce the diameter and/or the length of the mooring line used. Both of these solutions result in a wound mooring line with a smaller overall diameter of the coil defined by the wound mooring line. However, using a smaller diameter of mooring line may compromise the strength of the mooring line and using a shorter mooring line limits the distance at which the watercraft can be from a structure on a mooring permitting attachment of the mooring line.

Therefore, there is a desire for a mooring line assembly that provides the convenience of a retractable mooring line assembly, while addressing the inconveniences of such assemblies.

SUMMARY

It is an object of the present technology to ameliorate at least some of the inconveniences present in the prior art.

The present technology provides a retractable mooring line assembly for a watercraft. The mooring line assembly has an elastic line connected at one end to the watercraft and at the other end to a mooring line. The mooring line extends through a housing. The mooring line can be pulled out of the housing from a retracted position to a plurality of extended positions to attach the watercraft to a mooring, thereby stretching the elastic line. When the mooring line is disconnected from the mooring and released, the elastic line pulls the mooring line back to its retracted position.

According to one aspect of the present technology, there is provided a mooring line assembly for a watercraft. The watercraft defines at least one of a recess and a cavity. The mooring line assembly has an elastic line having a first end and a second end, the first end of the elastic line being adapted for connection to the watercraft; a mooring line having a first end and a second end, the first end of the mooring line being connected to the second end of the elastic line; and a housing adapted for connection to the watercraft, the mooring line extending through the housing. The mooring line is pullable through the housing from a retracted position to a plurality of extended positions. In the retracted position, when the mooring line assembly is provided on the watercraft, the elastic line and a majority of the mooring line are disposed in the at least one of the recess and the cavity. In the retracted position: the elastic line has a first length, and a portion of the mooring line extending from the first end of the mooring line to the housing has a second length. In any one of the plurality of extended positions: the elastic line has a third length, the third length being greater than the first length, and the portion of the mooring line extending from the first end of the mooring line to the housing has a fourth length, the fourth length being less than the second length. The elastic line is adapted for returning the mooring line to the retracted position from the plurality of extended positions.

In some embodiments, a lock cooperates with the mooring line for locking the mooring line in any one of the plurality of extended positions.

In some embodiments, the lock is connected to the housing.

In some embodiments, the lock is a clamp pivotally connected to the housing.

In some embodiments, a stopper is connected to one of the mooring line and the elastic line at a position between the housing and the first end of the elastic line when the mooring line is in the retracted position. The stopper engages the housing when the mooring line is at a maximum extended position of the plurality of extended positions for preventing the mooring line from being pulled out further from the housing.

In some embodiments, a connector connects the second end of the elastic line to the first end of the mooring line. The stopper is connected to the connector.

In some embodiments, an anchor is provided in the housing for connecting an end of an elastic line of another mooring line assembly.

In some embodiments, a stopper is connected to the second end of the mooring line. The stopper engages the housing when the mooring line is at the retracted position for preventing the mooring line from passing through the housing.

In some embodiments, the first length is less than an overall length of the mooring line.

In some embodiments, the first length is about half the overall length of the mooring line.

In some embodiments, when the mooring line is at a maximum extended position of the plurality of extended positions, the third length is greater than the overall length of the mooring line.

In some embodiments, the mooring line assembly has a pulley. A combination of the elastic line and the mooring line defines a combined line. The combined line extends from the first end of the elastic line to the pulley, then engages a portion of the pulley, and then extends from the pulley to the housing.

In some embodiments, a bracket is adapted for connection inside the watercraft between a hull and a deck of the watercraft. The pulley is mounted to the bracket.

According to another aspect of the present technology, there is provided a watercraft having a hull; a deck connected to the hull; and a mooring line assembly according to the above aspect and/or any one of the above embodiments connected to at least one of the hull and the deck.

In some embodiments, the at least one of the recess and the cavity is defined at least partially about an outer surface of the watercraft.

In some embodiments, the hull has a lip; the deck has a lip connected to the lip of the hull; and the at least one of the recess and the cavity is defined at least partially by at least one of the lips.

In some embodiments, the at least one of the recess and the cavity includes the cavity. The watercraft also has a bumper covering the lips of the hull and the deck. The bumper defines at least a portion of the cavity.

In some embodiments, the mooring line assembly is a first mooring line assembly. The watercraft also has a second mooring line assembly according to the above aspect and/or any one of the above embodiments. The housing of the first mooring line assembly is disposed forward of the housing of the second mooring line assembly.

In some embodiments, the first end of the elastic line of the first mooring assembly is connected to the housing of the second mooring line assembly. The first end of the elastic line of the second mooring assembly is connected to the housing of the first mooring line assembly.

In some embodiments, the at least one of the recess and the cavity includes the cavity. The cavity is defined between the hull and the deck.

In some embodiments, in the retracted position, a majority of the elastic line and a majority of the mooring line extend longitudinally inside the cavity.

In some embodiments, a guide is disposed inside the cavity. At least one of the elastic line and the mooring line extends through the guide.

In some embodiments, the mooring line assembly is a first mooring line assembly. The watercraft also has a second mooring line assembly according to the above aspect and/or any one of the above embodiments. The housing of the first mooring line assembly is disposed forward of the housing of the second mooring line assembly. In the retracted positions of the mooring lines of the first and second mooring line assemblies, a part of the mooring line of the first mooring line assembly overlaps the elastic line of the second mooring line assembly, and the elastic line of the first mooring line assembly overlaps a part of the mooring line of the second mooring line assembly.

According to another aspect of the present technology, there is provided a mooring line assembly for a watercraft. The mooring line assembly has an elastic line having a first end and a second end, the first end of the elastic line being adapted for connection to the watercraft; a mooring line having a first end and a second end, the first end of the mooring line being connected to the second end of the elastic line; and a housing adapted for connection to the watercraft. The mooring line extends through the housing. The mooring line is pullable through the housing from a retracted position to a plurality of extended positions. The mooring line assembly also has a lock cooperating with the mooring line for locking the mooring line in any one of the plurality of extended positions. In the retracted position: the elastic line has a first length, and a portion of the mooring line extending from the first end of the mooring line to the housing has a second length. In any one of the plurality of extended positions: the elastic line has a third length, the third length being greater than the first length, and the portion of the mooring line extending from the first end of the mooring line to the housing has a fourth length, the fourth length being less than the second length. The elastic line is adapted for returning the mooring line to the retracted position from the plurality of extended positions.

In some embodiments, the lock is connected to the housing.

In some embodiments, the lock is a clamp pivotally connected to the housing.

In some embodiments, a stopper is connected to one of the mooring line and the elastic line at a position between the housing and the first end of the elastic line when the mooring line is in the retracted position. The stopper engages the housing when the mooring line is at a maximum extended position of the plurality of extended positions for preventing the mooring line from being pulled out further from the housing.

In some embodiments, a connector connects the second end of the elastic line to the first end of the mooring line. The stopper is connected to the connector.

In some embodiments, an anchor is provided in the housing for connecting an end of an elastic line of another mooring line assembly.

In some embodiments, a stopper is connected to the second end of the mooring line. The stopper engages the housing when the mooring line is at the retracted position for preventing the mooring line from passing through the housing.

In some embodiments, the first length is less than an overall length of the mooring line.

In some embodiments, the first length is about half the overall length of the mooring line.

In some embodiments, when the mooring line is at a maximum extended position of the plurality of extended positions, the third length is greater than the overall length of the mooring line.

In some embodiments, the mooring line assembly has a pulley. A combination of the elastic line and the mooring line defines a combined line. The combined line extends from the first end of the elastic line to the pulley, then engages a portion of the pulley, and then extends from the pulley to the housing.

In some embodiments, a bracket is adapted for connection inside the watercraft between a hull and a deck of the watercraft. The pulley is mounted to the bracket.

According to another aspect of the present technology, there is provided a watercraft having a hull; a deck connected to the hull; and a mooring line assembly according to the above aspect and/or any one of the above embodiments connected to at least one of the hull and the deck.

In some embodiments, the mooring line assembly is a first mooring line assembly. The watercraft also has a second mooring line assembly according to the above aspect and/or any one of the above embodiments. The housing of the first mooring line assembly is disposed forward of the housing of the second mooring line assembly.

In some embodiments, the first end of the elastic line of the first mooring assembly is connected to the housing of the second mooring line assembly. The first end of the elastic line of the second mooring assembly is connected to the housing of the first mooring line assembly.

In some embodiments, in the retracted positions of the mooring lines of the first and second mooring line assemblies, a portion of the mooring line of the first mooring line assembly overlaps the elastic line of the second mooring line assembly, and the elastic line of the first mooring line assembly overlaps a portion of the mooring line of the second mooring line assembly.

For the purposes of this application, terms related to spatial orientation, such as front, rear, forward, rearward, left, right, above and below, should be understood as they would be understood by a driver of the watercraft sitting in the watercraft in a normal driving position.

Embodiments of the present technology, each have at least one of the above-mentioned objects and/or aspects, but do not necessarily have all of them. It should be understood that some aspect of the present technology that have resulted from attempting to attain the above-mentioned objects may not satisfy these objects and/or may satisfy other objects not specifically recited herein.

Additional and/or alternative features, aspects, and advantages of the embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with reference to a personal watercraft 10 and a boat 200. It is contemplated that the present technology could be used with other types of watercraft.

Figure 1:
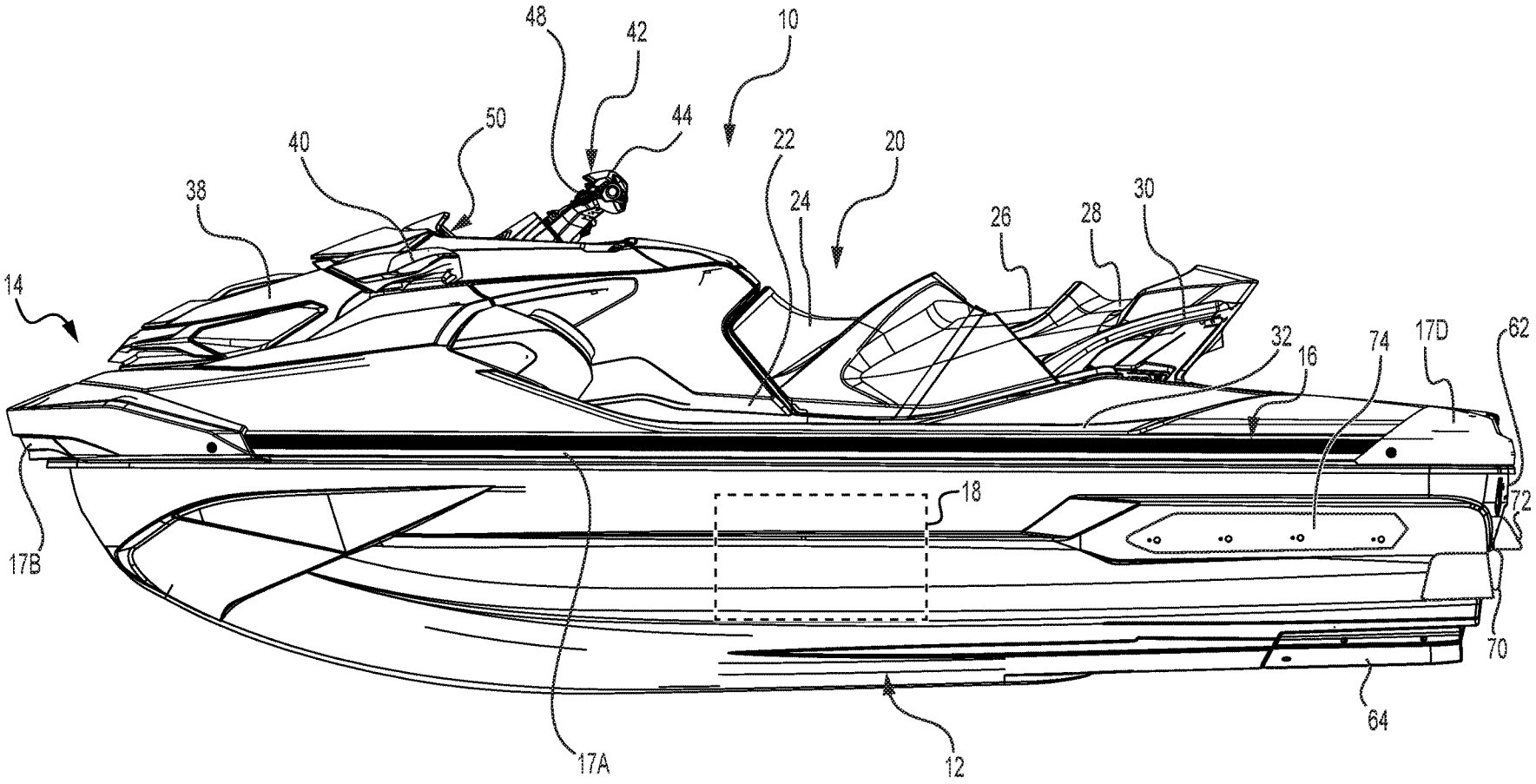
FIG. 1 is a left side elevation view of a personal watercraft.
Figure 2:
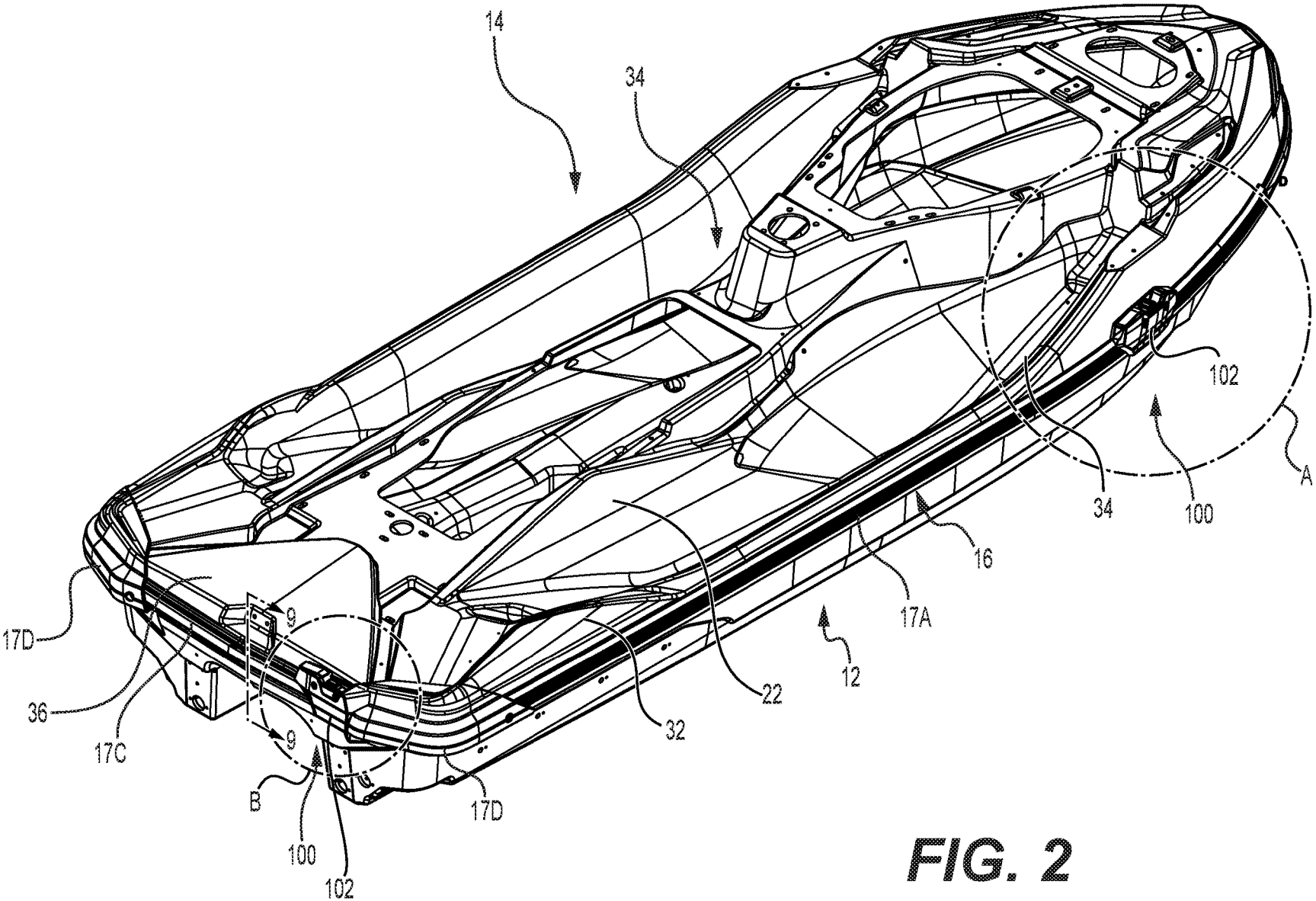
FIG. 2 is a perspective view taken from a rear, right side of a hull, a deck, bumpers and mooring line assemblies of the personal watercraft of FIG. 1.

The general construction of the personal watercraft 10 in accordance with the present technology is shown in FIGS. 1 and 2. The following description relates to one way of manufacturing a personal watercraft. Those of ordinary skill in the watercraft art will recognize that there are other known ways of manufacturing and designing watercraft and that this technology would encompass these other known ways and designs.

Figure 7:
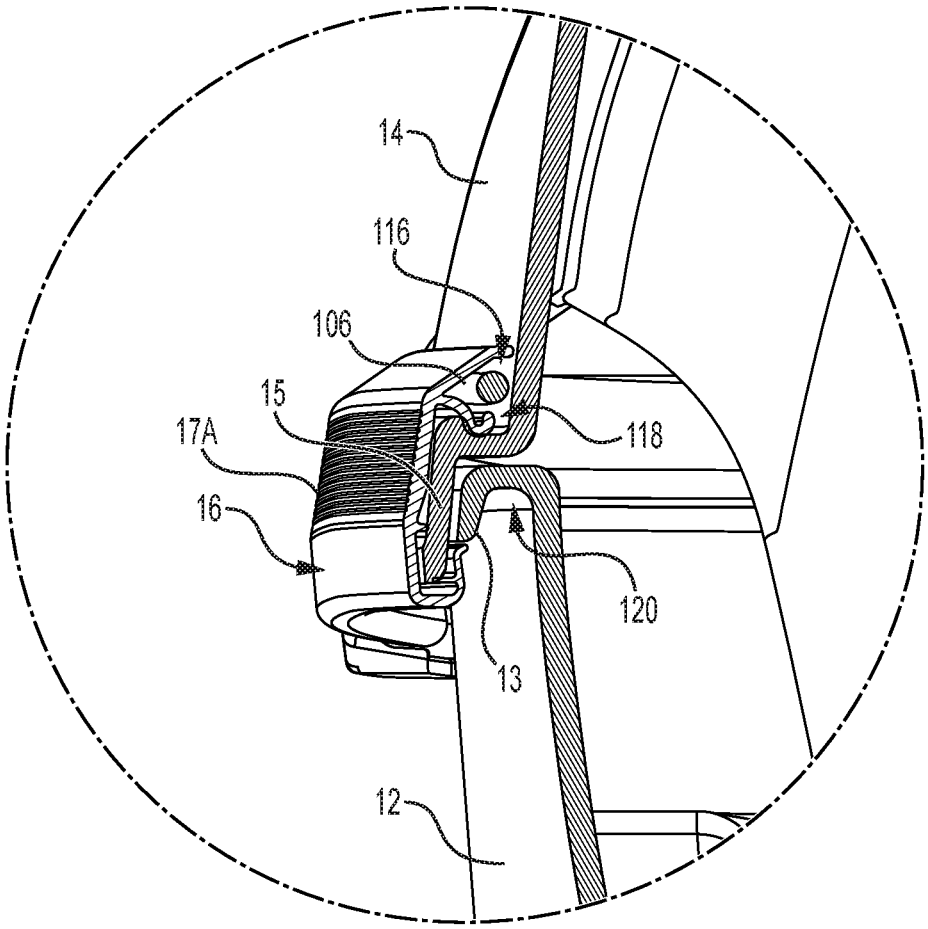
FIG. 7 is a cross-sectional view of the components of FIG. 2 taken through line 7-7 of FIG. 3.
Figure 8:
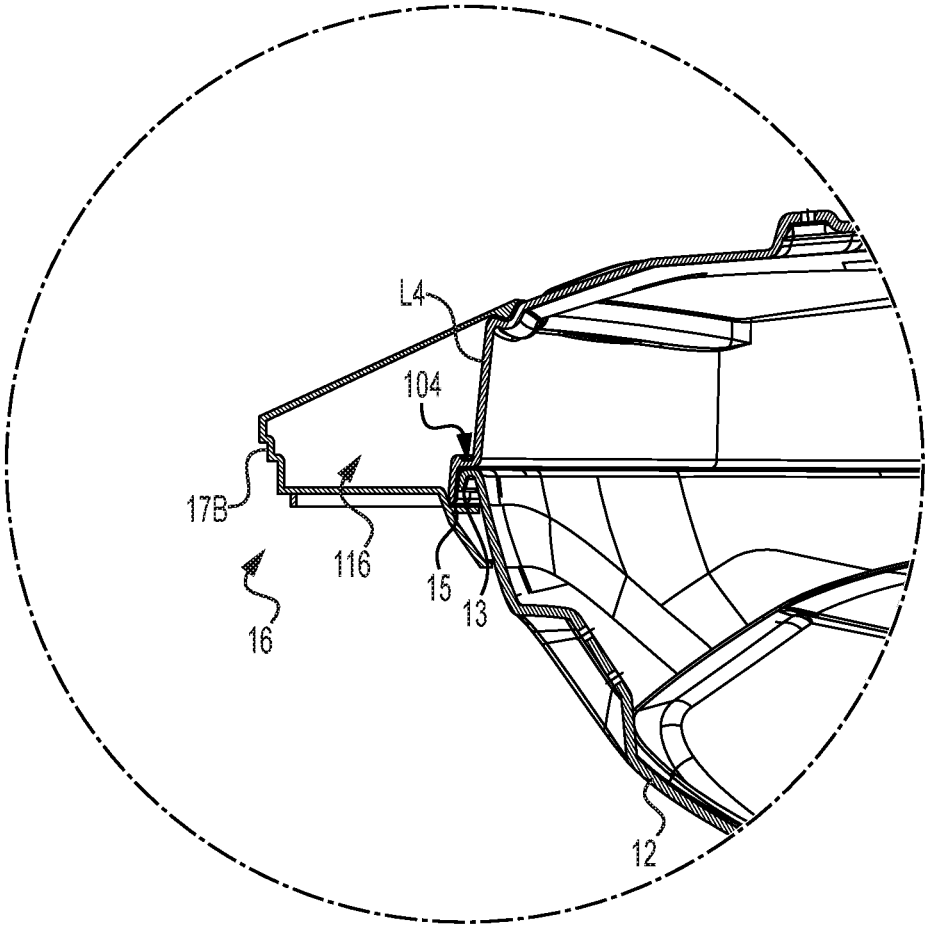
FIG. 8 is a longitudinal cross-section of a front part of the components of FIG. 2.
Figure 9:
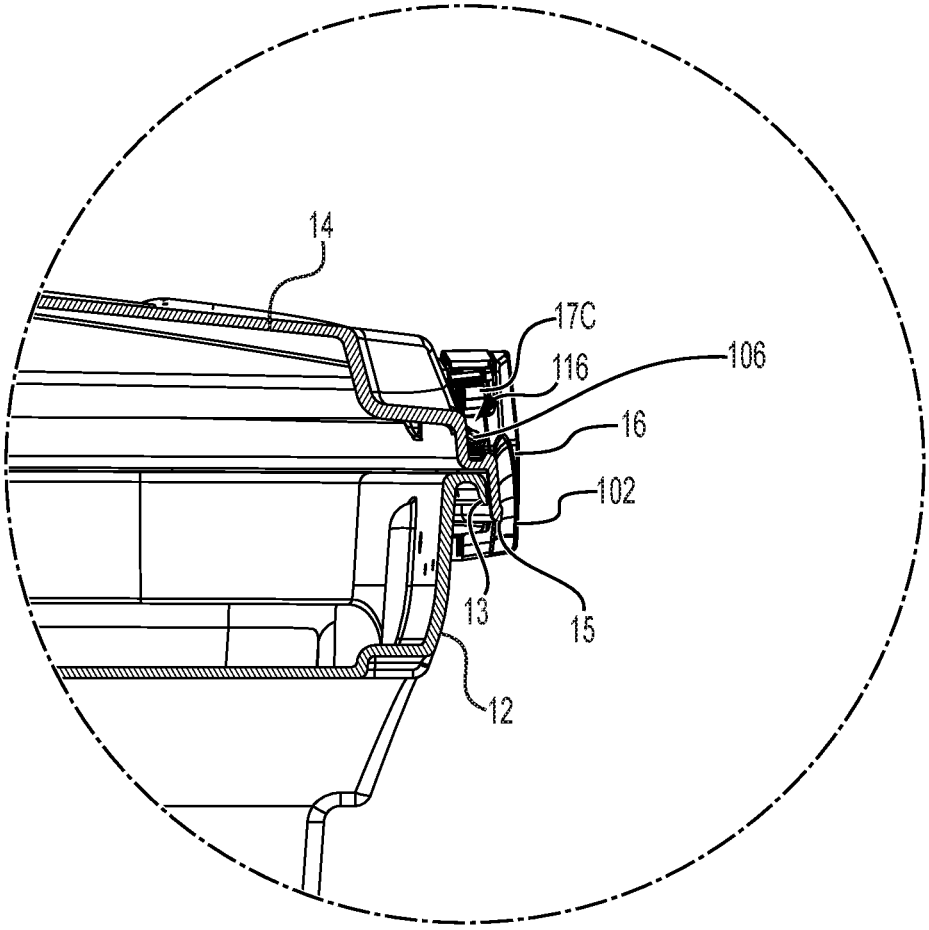
FIG. 9 is a cross-sectional view of the components of FIG. 2 taken through line 9-9 of FIG. 3.

The personal watercraft 10 of FIG. 1 has a hull 12 and a deck 14. The hull 12 buoyantly supports the personal watercraft 10 in the water. The deck 14 is designed to accommodate a driver and two passengers. It is contemplated that the deck 14 could be designed to accommodate only the driver, only the driver and one passenger, or the driver and more than two passengers. As can be seen in FIGS. 7 to 9, the hull 12 has a lip 13 defining a contour thereof and the deck 14 has a lip 15 defining a contour thereof. The lip 15 of the deck 14 sits on top of the lip 13 of the hull 12 and they are connected to each other in a sealing relationship. The lips are connected by an adhesive, but other known joining methods could be used to connect the hull 12 and deck 14 together, including but not limited to thermal fusion or fasteners such as rivets or screws. A bumper 16 generally covers the lips 13, 15, which helps to prevent damage to the outer surface of the personal watercraft 10 when the personal watercraft 10 is docked, for example.

The bumper 16 includes port and starboard side bumper portions 17A, a front bumper portion 17B, a rear bumper portion 17C, and port and starboard rear corner bumper portions 17D. The port and starboard side bumper portions 17A cover the lips 13, 15 on the port and starboard sides of the personal watercraft 10. As can be seen in FIG. 7, the port and starboard side bumper portions 17A are connected to the lips 13, 15 by clips defined by the port and starboard bumper portions 17A, extending around the upper and lower edges of the lip 15. Similarly, the rear bumper portion 17C covers the lips 13, 15 at the rear of the personal watercraft 10 and is similarly clipped onto the lips 13, 15. The front bumper portion 17B covers the lips 13, 15 at the front of the personal watercraft 10 and overlaps the front ends of the port and starboard side bumper portions 17A. The port and starboard rear corner bumper portions 17D cover the lips 13, 15 at the port and starboard rear corners of the personal watercraft 10. The port and starboard rear corner bumper portions 17D overlap the rear ends of the port and starboard side bumper portions 17A and the left and right ends of the rear bumper portion 17C. The front bumper portion 17B and the port and starboard rear corner bumper portions 17D are fastened to the deck 14. It is contemplated that the bumper 16 could have more or less portions than described above. It is also contemplated that the portions of the bumper 16 could be connected to the deck 14 and/or hull 12 in a manner that is different from the ones described above.

The space between the hull 12 and the deck 14 forms a volume referred to herein as the motor compartment. The motor compartment houses a motor, which in the present embodiment is an internal combustion engine 18 (shown schematically in FIG. 1). The motor compartment also houses a muffler, gas tank, electrical system (battery, electronic control unit, etc.), air box, storage bins, and other elements required or desirable in the personal watercraft 10.

The deck 14 has a centrally positioned straddle seat 20 positioned on top of a pedestal 22 to accommodate the driver and two passengers in a straddling position. The seat 20 includes a front seat portion 24, a central seat portion 26, and a rear seat portion 28. The seat 20 is removably attached to the pedestal 22. The seat 20 covers an engine access opening defined by a top portion of the pedestal 22 to provide access to the engine 18. A grab handle 30 is provided between the pedestal 22 and the rear of the seat 20 to provide a handle onto which a passenger may hold.

The deck 14 has a pair of generally upwardly extending walls located on either side of thereof known as gunwales or gunnels 32. Located on both sides of the personal watercraft 10, between the pedestal 22 and the gunnels 32 are the footrests 34 (FIG. 2). The footrests 34 are designed to accommodate the riders' feet in various riding positions. A reboarding platform 36 (FIG. 2) is provided at the rear of the deck 14 to allow the rider or a passenger to easily reboard the personal watercraft 10 from the water.

The deck 14 is provided with a hood 38 located forward of the seat 20. The hood 38 is pivotally connected to allow the hood 38 to move to an open position to provide access to a storage bin (not shown). Rearview mirrors 40 are positioned on either side of the deck 14 forward of the seat 20 to allow the driver to see behind the personal watercraft 10.

A helm assembly 42 is positioned forward of the seat 20 and rearward of the hood 38. The helm assembly 42 has a pair of steering handles 44. The right steering handle 44 is provided with a throttle operator (not shown), which allows the driver to control the engine 18. The left steering handle 44 is provided with a lever 48 used by the driver to decelerate the personal watercraft 10 as described in greater detail below.

A display cluster 50 is located forwardly of the helm assembly 42. The display cluster 50 can be of any display type, including a liquid crystal display (LCD), gauges, dials or LED (light emitting diodes). The helm assembly 42 has various buttons 52, which could alternatively be in the form of levers or switches, that allow the driver to modify the display data or mode (speed, engine rpm, time . . . ) on the display cluster 50 or to change a condition of the personal watercraft 10, such as trim (i.e. the pitch of the personal watercraft 10).

The personal watercraft 10 is propelled by a jet propulsion system (not shown). It is contemplated that the personal watercraft 10 could be propelled by a marine propulsion system other than the jet propulsion system. The jet propulsion system scoops water from under the hull 12 through an inlet, which has an inlet grate (both not shown). The inlet grate prevents large rocks, weeds, and other debris from entering the jet propulsion system, which may damage the system or negatively affect performance. Water flows from the inlet through a water intake ramp 60 (not shown). The top portion of the water intake ramp 60 is formed by the hull 12, and a pump support (not shown), also known as a ride shoe, forms its bottom portion. Alternatively, the intake ramp may be a single piece or an insert.

From the intake ramp, water enters a jet pump (not shown). The jet pump is located in a formation in the hull 12, referred to as the tunnel 62, and is mounted to the pump support. The tunnel 62 is defined at the front, sides, and top by the hull 12 and is open at the rear. The bottom of the tunnel 62 is closed by a ride plate 64. The ride plate 64 is attached to the bottom of the hull 12 and creates a surface on which the personal watercraft 10 rides or planes at high speeds. The jet pump includes an impeller (not shown) and a stator (not shown). The impeller is coupled to the engine 18 by an impeller shaft (not shown) and a driveshaft (not shown). Once the water leaves the jet pump, it goes through a venturi (not shown). A steering nozzle 70 is pivotally attached to the venturi so as to pivot about a vertical axis. It is contemplated that the steering nozzle 70 could be replaced by a rudder or other diverting mechanism disposed at the exit of the tunnel 62 to selectively direct the thrust generated by the jet propulsion system 54 to effect turning. The steering nozzle 70 is operatively connected to the helm assembly 42 via a push-pull cable (not shown) or via a steering-by-wire system. The steering nozzle 70 may be gimbaled to allow it to move about a horizontal pivot axis to permit trim which controls the pitch of the personal watercraft 10.

The personal watercraft 10 is provided with a reverse gate 72 which is movable between a stowed position (shown in FIG. 1) where it does not interfere with the jet of water being expelled by the jet propulsion system 54 and a plurality of positions where it redirects the jet of water being expelled by the jet propulsion system 54. Actuating the lever 48 on the helm assembly 42 sends a signal to an actuator, such as an electric motor, to move the reverse gate 72 to a position where the jet of water is redirected to decelerate the personal watercraft 10 or to make the personal watercraft 10 move in a reverse direction. It is contemplated that the reverse gate 72 could be actuated differently.

Sponsons 74 (only a port one of which is shown in FIG. 1) are disposed on both sides of the hull 12 near the rear of the hull 12. It is contemplated that the sponsons 74 could be optional. The sponsons 74 have an undersurface that gives the personal watercraft 10 both lift while in motion and improved turning characteristics.

As can be seen in FIG. 2, the personal watercraft 10 is provided with front and rear mooring line assemblies 100. It is contemplated that only one of the front and rear mooring line assemblies 100 may be provided or that a single mooring line assembly 100 could be provided at a location different from that shown in FIG. 2. It is also contemplated that more than two mooring line assemblies 100 could be provided. As will be described in greater detail below, and with reference to FIGS. 2 to 14, each mooring line assembly includes a housing 102, an elastic line 104, a mooring line 106, a lock 108, a connector 110, and a stopper 112. The elastic lines 104 are made from bundles of rubber strands surrounded by a woven sheath. Other types of elastic lines are contemplated. In some embodiments, each elastic line 104 can be stretched up to three times its original unstretched length.

Figure 4:
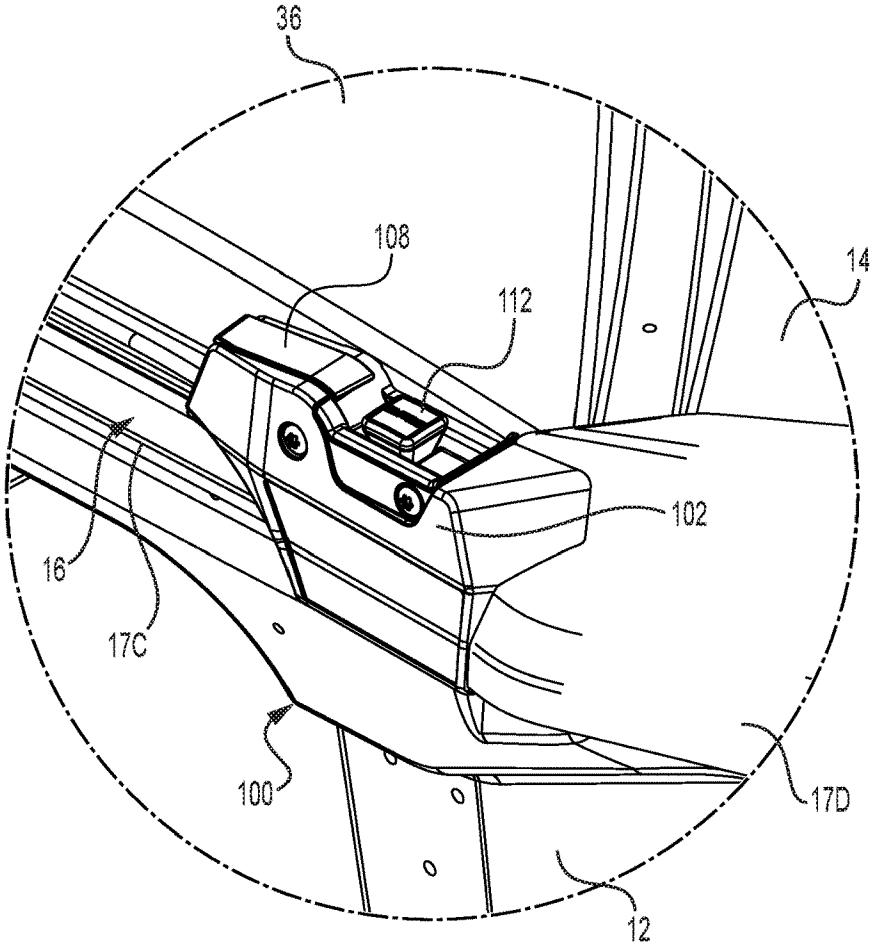
FIG. 4 is a close-up view of portion B of FIG. 2 showing a housing of a rear mooring line assembly of the personal watercraft of FIG. 1 with the mooring line in a retracted position.
Figure 3:
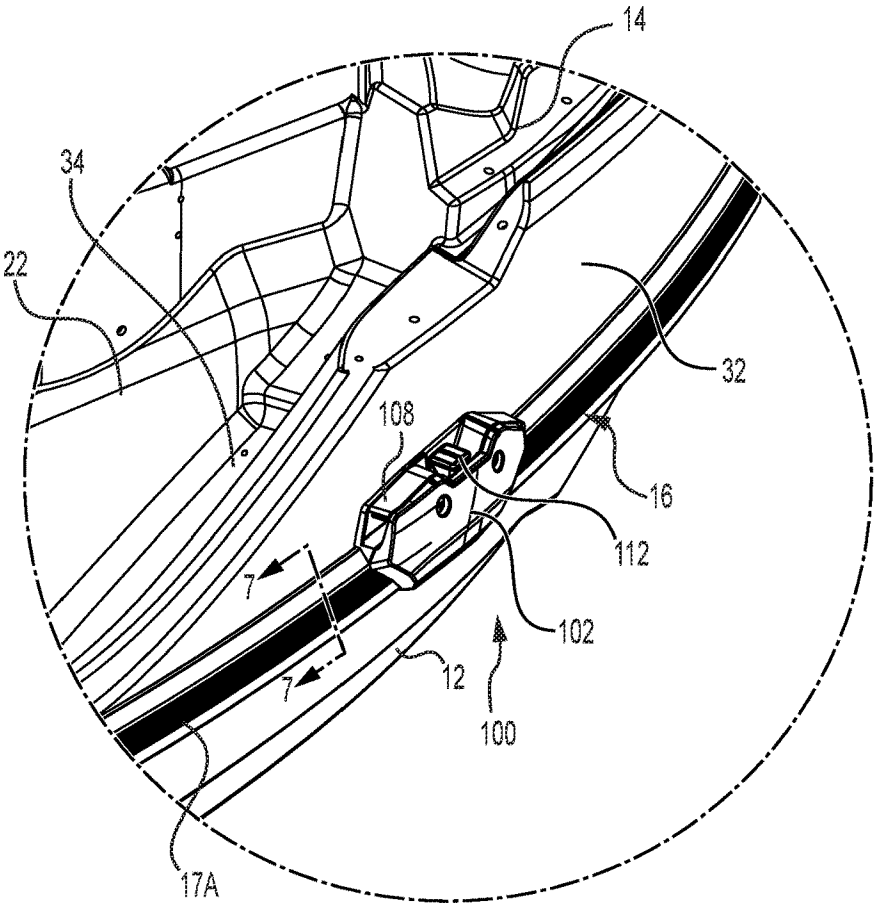
FIG. 3 is a close-up view of portion A of FIG. 2 showing a housing of a front mooring line assembly of the personal watercraft of FIG. 1 with the mooring line in a retracted position.

As can be seen in FIGS. 2 and 3, the housing 102 of the front mooring line assembly 100 is connected to the deck 14 on an outer surface of the starboard gunnel 32 near a front of the personal watercraft 10. As can be seen in FIGS. 2 and 4, the housing 102 of the rear mooring line assembly 100 is connected to the deck 14 on a rear surface of the reboarding platform 36 near a rear, right corner of the personal watercraft 10. Both housings 102 overlap the bumper 16. It is contemplated that in some embodiments, one or both housings 102 could be connected on the hull 12 or elsewhere on the deck 14. For example, it is contemplated that both housings 102 could be connected to the port gunnel 32.

Figure 5:
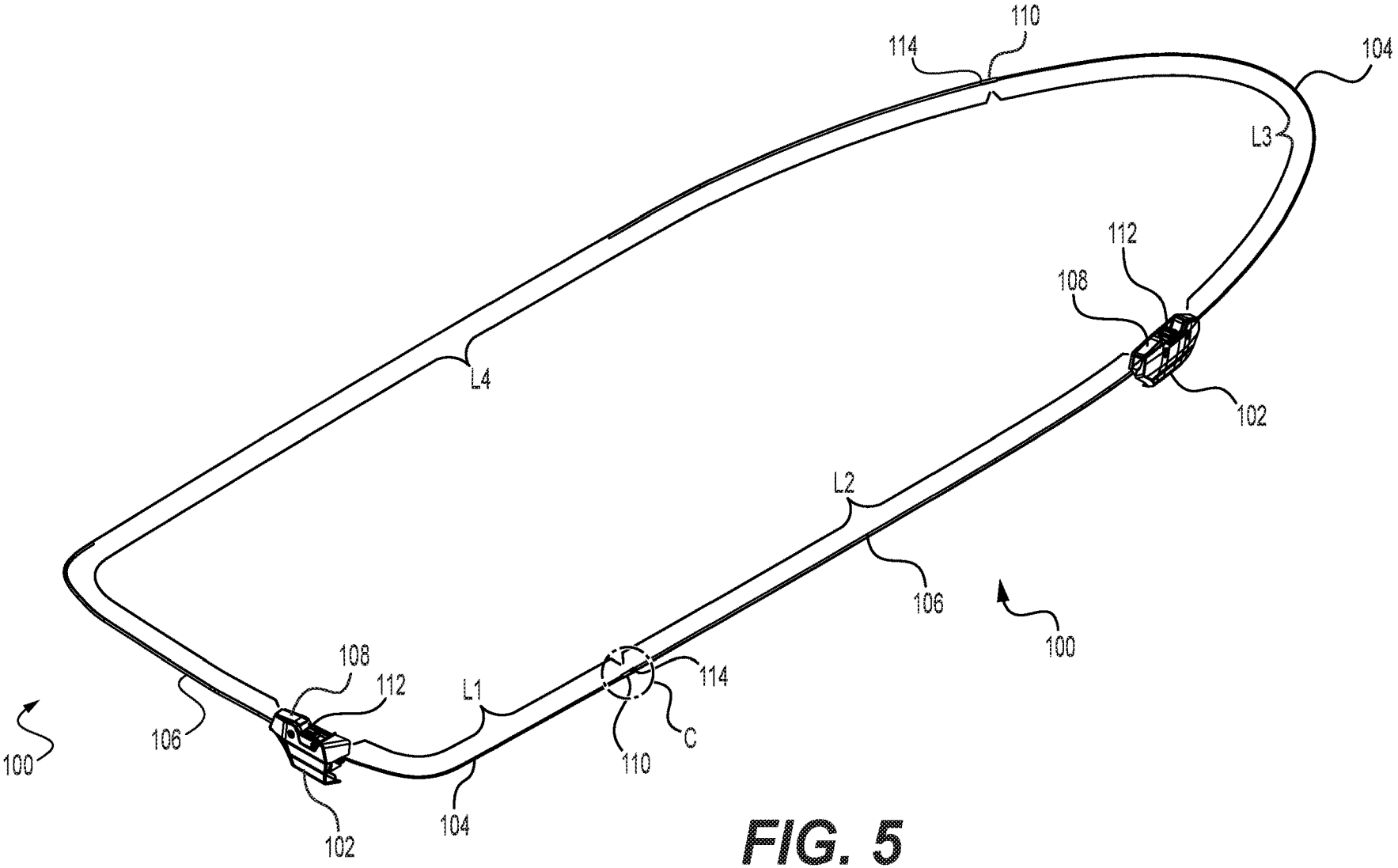
FIG. 5 is a perspective view taken from a rear, right side of the mooring line assemblies of the personal watercraft of FIG. 1, shown in retracted positions of the mooring lines as installed on the personal watercraft.
Figure 10:
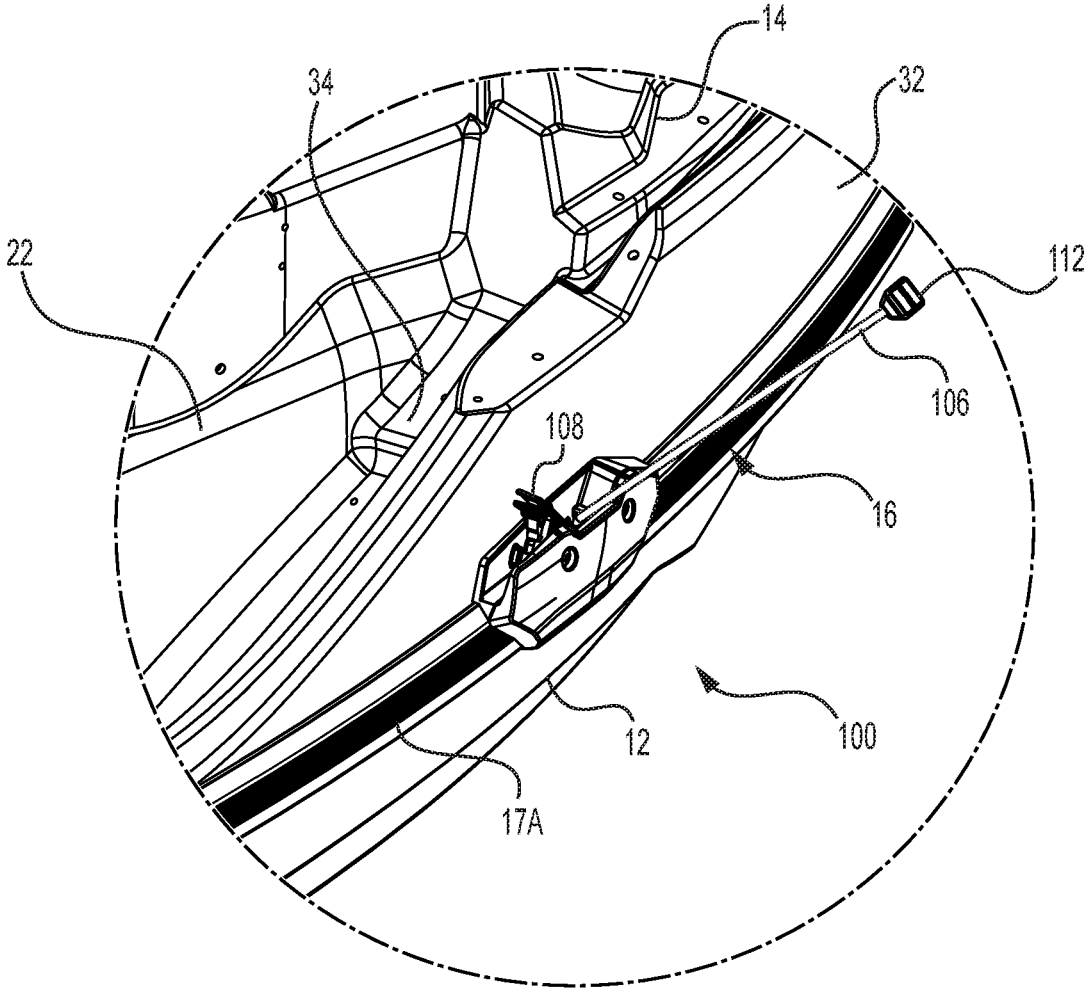
FIG. 10 is a close-up view of portion A of FIG. 2 showing the housing of a front mooring line assembly of the personal watercraft of FIG. 1 with the mooring line in an extended position and a lock in an unlocked position.

With reference to FIG. 5, the elastic line 104 of the front mooring line assembly 100 is connected at one end to the housing 102 of the rear mooring line assembly 100 as will be described in more detail below. It is contemplated that this end of the elastic line 104 could alternatively be connected to the hull 12, the deck 14, the bumper 16 or to a bracket or other component connected to one of the hull 12, the deck 14 and the bumper 16. The other end of the elastic line 104 is connected to one end of the mooring line 106 by the connector 110. The mooring line 106 extends through the housing 102. The stopper 112 is connected to the other end of the mooring line 106. When the lock 108 is in an unlocked position as shown in FIG. 10, the mooring line 106 can be pulled out of the housing 102 in a plurality of extended positions until a sufficient length of mooring line 106 is available to connect the mooring line 106, and hence the watercraft 10, to a mooring. Pulling the mooring line 106 out of the housing 102 stretches the elastic line 104. To prevent the mooring line 106 from being pulled back through the housing 102 by the elastic line 104, the lock 108 is put into a locked position (FIG. 3 shows the locked position of the lock 108) so as to cooperate with the mooring line 106 to lock the mooring line 106 in the desired extended position with respect to the housing 102. When the lock 108 is in the locked position, the mooring line 106 is secured against the housing 102, as will be discussed in further detail below, which prevents forces resulting from the connection of the mooring line 106 to a mooring from being transmitted to the elastic line 104. When the mooring line 106 is disconnected from the mooring, the lock 108 is put back in the unlocked position and the elastic line 104 contracts and pulls the mooring line 106 back through the housing 102. The stopper 112 prevents the mooring line 106 from being pulled completely through the housing 102. The position at which the stopper 112 engages the housing 102 and stops the mooring line 106 when the lock 108 is in the unlocked position is referred to as the retracted position of the mooring line 106. Once the mooring line 106 is in the retracted position, the lock 108 can be put in the locked position again as shown in FIGS. 2, 3 and 5.

Figure 6:
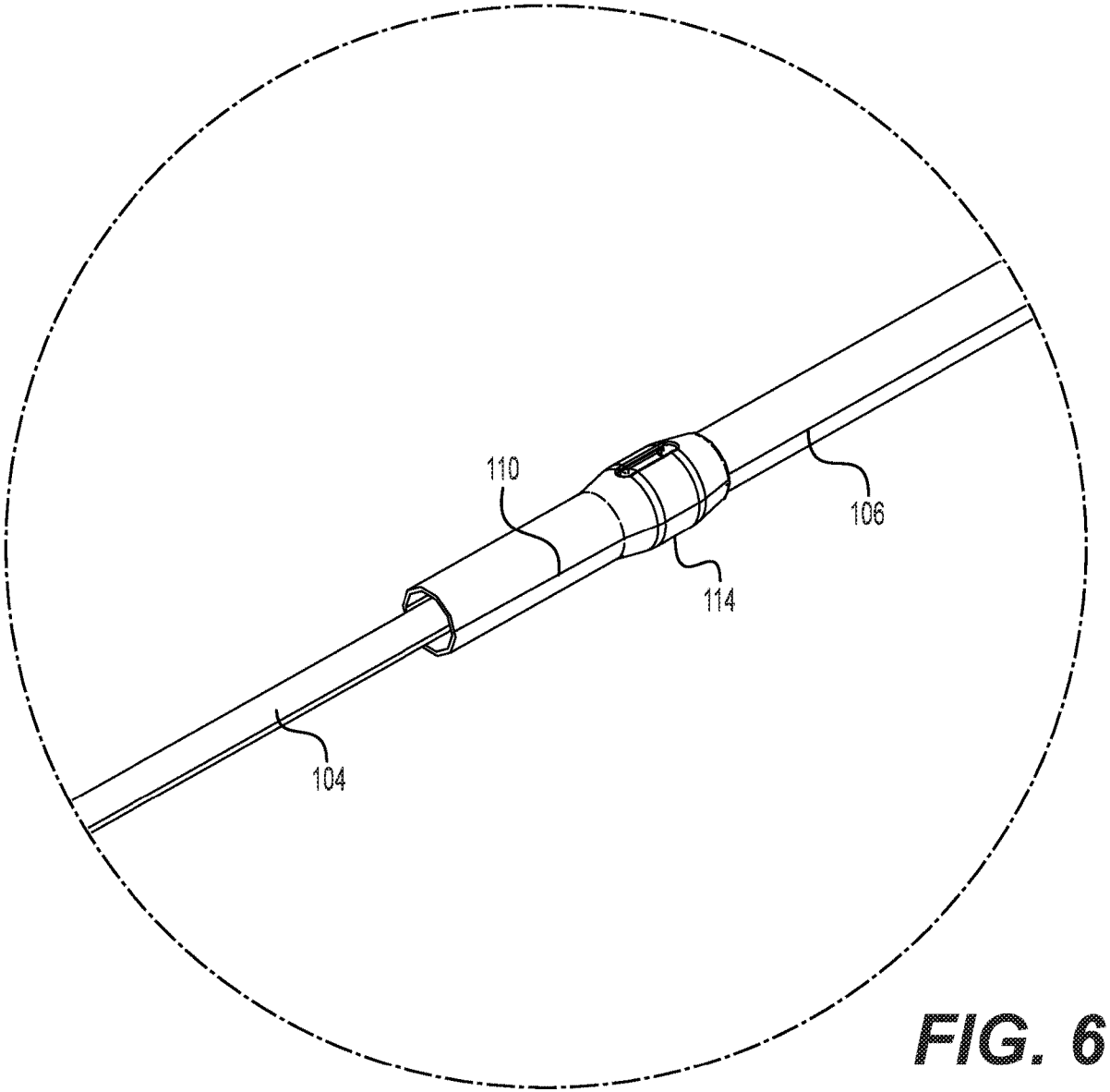
FIG. 6 is a close-up view of portion C of FIG. 5 showing a connector of the front mooring line assembly of the personal watercraft of FIG. 1.

In order to prevent the mooring line 106 of the front mooring line assembly 100 from being pulled too far through the housing 102, which could result in the elastic line 104 being engaged by the lock 108 instead of the mooring line 106, a stopper 114 is connected to the connector 110. As can be seen in FIG. 6, in the present embodiment, the stopper 114 is integrally formed with the connector 110 and is in the form of a bulge. The stopper 114 is too big to pass through the housing 102. The position at which the stopper 114 engages the housing 102 and stops the mooring line 106 from being pulled any further out of the housing 102 is referred to as the maximum extended position of the mooring line 106. The maximum extended position of the mooring line 106 is the extended position of the mooring line 106 with the greatest length of mooring line 106 available to connect the mooring line 106 to a mooring. It is contemplated that the stopper 114 could be an element separate from the connector 110 and connected to the mooring line 106 near the connector 110. It is also contemplated that one or more knots made in the mooring line 106 near the connector 110 could be the stopper.

With reference to FIG. 5, the elastic line 104 of the rear mooring line assembly 100 is connected at one end to the housing 102 of the front mooring line assembly 100. It is contemplated that this end of the elastic line 104 could alternatively be connected to the hull 12, the deck 14, the bumper 16 or to a bracket or other component connected to one of the hull 12, the deck 14 and the bumper 16. The other end of the elastic line 104 is connected to one end of the mooring line 106 by the connector 110. The mooring line 106 extends through the housing 102. The stopper 112 is connected to the other end of the mooring line 106. The lock 108 is operable in the same way as the lock 108 of the front mooring line assembly 100 in order to lock the mooring line 106 in position when locked and, when unlocked, to permit the mooring line 106 to be pulled through the housing 102 to an extended position or to be returned to its retracted position by the elastic line 104. As with the front mooring line assembly 100, the stopper 112 prevents the mooring line 106 from being pulled completely through the housing 102 when being returned to its retracted position, and a stopper 114 prevents the mooring line 106 from being pulled out too far when being pulled to its maximum extended position.

With reference to FIGS. 5 and 7 to 9, the portions of the mooring lines 106 disposed between their respective housings 102 and connectors 110, the elastic lines 104 and the connectors 110 are received in cavities 116 defined between the bumper 16 and an outer surface of the personal watercraft 10. More specifically, for the front mooring line assembly 100, the portion of mooring line 106 disposed between the housing 102 and the connector 110, the elastic line 104 and the connector 110 are disposed in a cavity 116 defined by an outer surface of the deck 14 on the inside, by the lip 15 of the deck 14 at the bottom, and by the starboard side bumper portions 17A (see FIG. 7) and the starboard rear corner bumper portion 17D on the outside and top. For the rear mooring line assembly 100, the portion of mooring line 106 disposed between the housing 102 and the connector 110, the elastic line 104 and the connector 110 are disposed in a cavity 116 defined by an outer surface of the deck 14 on the inside, by the lip 15 of the deck 14 at the bottom, and by the starboard side bumper portions 17A, the front bumper portion 17B (see FIG. 8), the port bumper portion 17A, the port rear corner bumper portion 17D and the rear bumper portion 17C (see FIG. 9) on the outside and top. It is contemplated that in alternative embodiments, the portions of the mooring lines 106 disposed between their respective housings 102 and connectors 110, the elastic lines 104 and the connectors 110 could be received in recesses such as the recess 118 defined by the lip 15 of the deck 14 or the recess 120 defined by the lip 13 of the hull 12 without having the bumper 16 cover the recess 118 or 120. It is also contemplated that in alternative embodiments, the portions of the mooring lines 106 disposed between their respective housings 102 and connectors 110, the elastic lines 104 and the connectors 110 could be received in the cavity defined between the hull 12 and the deck 14. In such embodiments, apertures are defined in the deck 14 (or the hull 12) to permit the passage of the mooring lines 106 to the cavity defined between the hull 12 and the deck 14. It is also contemplated that in alternative embodiments, the cavities 116 could be defined by an outer surface of the hull 12 on the inside, by the lip 13 of the hull 12 at the top, and by the bumper 16 on the outside and bottom. As would be understood from FIG. 5, in the retracted positions of the mooring lines 106, a majority of each mooring line 106 is received in its respective cavity 116. Also with reference to FIG. 5, in the retracted positions of the mooring lines 106, a majority of each mooring line 106 and a majority of the elastic line 104 of the front mooring line assembly 100 extend longitudinally in their respective cavities 116.

With reference to FIG. 5, for the front mooring line assembly 100, in the retracted position of the mooring line 106 as shown, the elastic line 104 extends toward the right from the housing 102 of the rear mooring line assembly 100, turns around the rear right corner of the deck 14 and then extends forward to the connector 110 and the mooring line 106 extends forward from the connector 110 to the housing 102 of the front mooring line assembly 100, and then through the housing 102. In the retracted position of the mooring line 106, the elastic line 104 has a length L1 and the portion of the mooring line 106 extending between the connector 110 and the housing 102 has a length L2. As can be seen, the length L1 is less than the length L2 and less than the overall length of the mooring line 106. In the present embodiment, the length L1 is about half the overall length of the mooring line 106. Although the mooring line 106 is not pulled out of the housing 102 in this position, the elastic line 104 is nonetheless in tension so as to keep the mooring line 106 in tension, however it is contemplated that this need not be the case. When the mooring line 106 is pulled through the housing 102 to any one of its extended positions, the elastic line 104 is stretched and therefore has a length greater than L1 and, since part of the mooring line 106 extends out of the housing 102, the portion of the mooring line 106 extending between the connector 110 and the housing 102 has a length that is less than the length L2. When the mooring line 106 is at its maximum extended position of the plurality of extended positions, the length of the elastic line 104 is greater than the overall length of the mooring line 106. In the present embodiment, the length of the elastic line 104 when the mooring line 106 is in its maximum extended position is about one and a half times the overall length of the mooring line 106.

With reference to FIG. 5, for the rear mooring line assembly 100, in the retracted position of the mooring line 106 as shown, the elastic line 104 extends forward and leftward from the housing 102 of the front mooring line assembly 100, then rearward and leftward to the connector 110 so as to go around the front of the deck 14 and the mooring line 106 extends rearward from the connector 110, turns around the rear left corner of the deck 14, then extends right to the housing 102 of the rear mooring line assembly 100, and then through the housing 102. In the retracted position of the mooring line 106, the elastic line 104 has a length L3 and the portion of the mooring line 106 extending between the connector 110 and the housing 102 has a length L4. As can be seen, the length L3 is less than the length L4 and less than the overall length of the mooring line 106. In the present embodiment, the length L3 is about half the overall length of the mooring line 106. Although the mooring line 106 is not pulled out of the housing 102 in this position, the elastic line 104 is nonetheless in tension so as to keep the mooring line 106 in tension, however it is contemplated that this need not be the case. When the mooring line 106 is pulled through the housing 102 to any one of its extended positions, the elastic line 104 is stretched and therefore has a length greater than L3 and, since part of the mooring line 106 extends out of the housing 102, the portion of the mooring line 106 extending between the connector 110 and the housing 102 has a length that is less than the length L4. When the mooring line 106 is at its maximum extended position of the plurality of extended positions the length of the elastic line 104 is greater than the overall length of the mooring line 106. In the present embodiment, the length of the elastic line 104 when the mooring line 106 is in its maximum extended position is about one and a half times the overall length of the mooring line 106.

In the present embodiment, the length L3 of the elastic line 104 of the rear mooring line assembly 100 is more than twice the length L1 of the elastic line 104 of the front mooring line assembly 100. In the present embodiment, the overall length of the mooring line 106 of the rear mooring line assembly 100 is more than twice the overall length of the mooring line 106 of the front mooring line assembly 100. For each mooring line assembly 100, the exact lengths of the elastic line 104 and the mooring line 106 will depend of the dimensions of the watercraft, on the desired length of mooring line 106 that is to be available to connect the mooring line 106 to a mooring when the mooring line is in maximum extended position, on the type of elastic lines 104 being used, and on the relative position of the housings 102 for embodiments where the elastic line 104 of one mooring line assembly 100 is connected to the housing 102 of the other mooring line assembly 100. Also, the overall length of each of the mooring lines 106 does not vary significantly when a tension force is applied to it.

Turning now to FIGS. 11 to 14, the housing 102, the lock 108 and the stopper 112 of the front mooring line assembly 100 will be described in more detail. The housing 102 of the rear mooring line assembly 100 differs in shape from the housing 102 of the front mooring line assembly 100 in order to properly interface with the starboard rear corner bumper portion 17D, but otherwise has the same features as the housing 102 of the front mooring line assembly 100. The lock 108 and the stopper 112 of the rear mooring line assembly 100 are the same as the lock 108 and the stopper 112 of the front mooring line assembly 100 and operates in the same way. Therefore, for simplicity, the housing 102, the lock 108 and the stopper 112 of the rear mooring line assembly 100 will not be described in detail herein. It is contemplated that the housings 102 of both mooring line assemblies 100 could be the same. It is also contemplated that the lock 108 of the rear mooring line assembly 100 could differ from the lock 108 of the front mooring line assembly 100. It is also contemplated that the stopper of the rear mooring line assembly 100 could differ from the stopper 112 of the front mooring line assembly 100.

Figure 12:
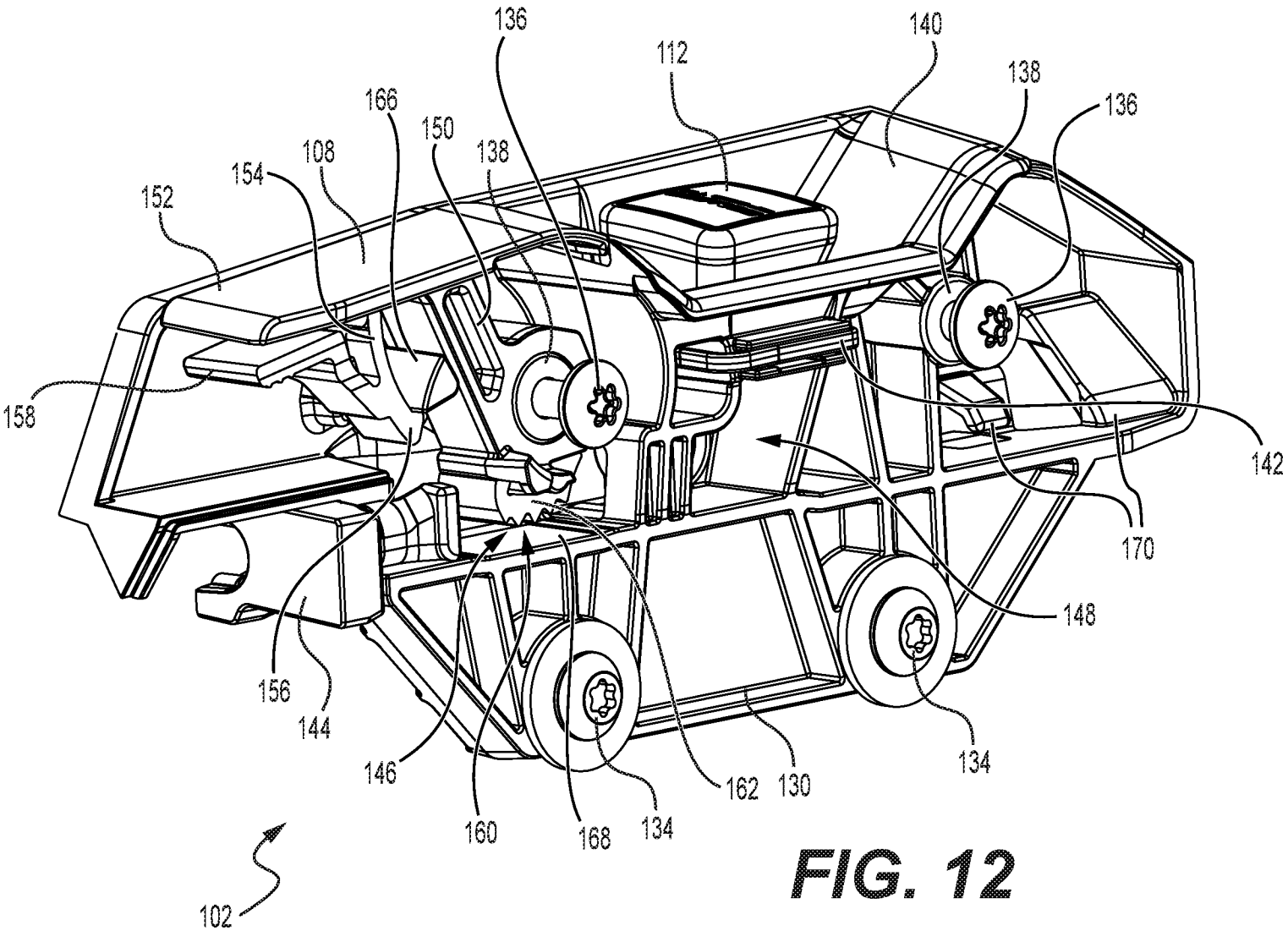
FIG. 12 is a perspective view taken from a rear, right side of the housing of FIG. 3 with the lock in a locked position and with a cover of the housing being removed.

The housing 102 includes a mount 130 and a cover 132. The mount 130 is fastened to the personal watercraft 10 by a pair of screws 134. It is contemplated that the mount 130 could be connected to the personal watercraft 10 by another type of fastener, or by other means. The connection between the mount 130 and the personal watercraft 10 is sufficiently strong to withstand the forces required to moor the personal watercraft 10. The cover 132 is fastened to the mount 130 by a pair of bolts 136 and corresponding nuts (not shown) on the inner side of the mount 130. It is contemplated that the cover 132 could be connected to the mount 130 by another type of fastener, or by other means. For example, the cover 132 could be clipped onto the mount 130. The bolts 136 extend through a pair of cylindrical bosses 138 (FIG. 12). The lock 108 is received around the rear boss 138 (i.e. the left boss 138 with reference to FIG. 12) so as to pivot relative to the housing 102 as will be described in more detail below. The cover 132 is aesthetic, but also maintains the axial position of the lock 108 which is held between the mount 130 and the cover 132 as can be seen in FIG. 102.

The mount 130 defines a tapered recess 140 on a top thereof. The recess 140 receives the stopper 112 therein when the mooring line 106 is in the retracted position. The bottom of the recess 140 is defined by a plate 142. The plate 142 defines an aperture (not shown) to guide the passage of the mooring line therethrough (see FIG. 14). The stopper 112 has a generally square top, a generally square bottom that is smaller than the top, and four tapering sides. The stopper 112 abuts the top of the plate 142 when the mooring line 106 is in the retracted position. The recess 140 is larger than the stopper 112 such that person can fit their fingers in the recess 140 to grab the stopper 112 and pull on the mooring line 106. It is contemplated that the mount 130 could not be provided with the recess 140 and that the stopper 112 could sit on top of the housing 102 when the mooring line 106 is in the retracted position. It is contemplated that the stopper 112 could differ from the type shown in the figures. For example, it is contemplated that the stopper 112 could be one or more knots in the mooring line 106.

Figure 14:
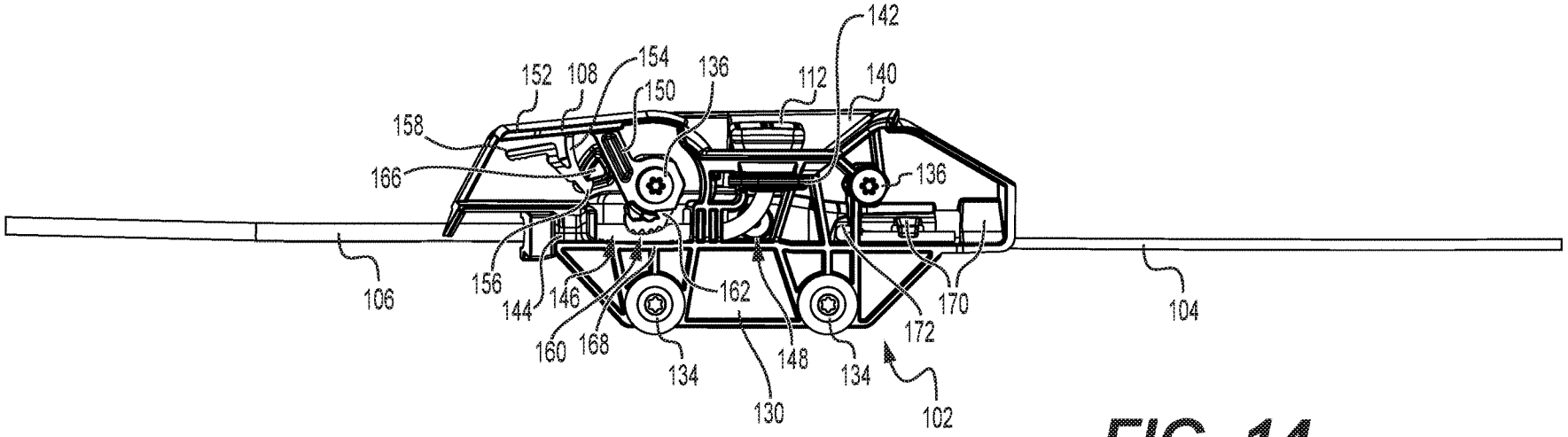
FIG. 14 is a right side elevation view of the components of FIG. 12 with the lock in the locked position and with the mooring line of the front mooring line assembly and the elastic line of the rear mooring line assembly being shown.

The mount 130 defines a mooring line guide 144 at a rear thereof. As can be seen in FIG. 14, the mooring line 106 passes through the mooring line guide 144, then extends in a linear passage 146 under the lock 108, then passes through an L-shaped passage 148, and finally passes through the aperture in the plate 142 to connect to the stopper 112. As such, when a user pulls the mooring line 106 out of the housing 102, the mooring line 106 comes out of the top of the housing 102. It is contemplated that in alternative embodiments the mount 130 could be arranged such that when a user pulls the mooring line 106 out of the housing 102, the mooring line 106 comes out of one of the front, bottom or rear of the housing 102, with stopper 112 being on the corresponding side of the housing 102 when the mooring line 106 is in the retracted position. It is also contemplated that the cover 132 could have an aperture defined therein, and that the mount 130 would be modified accordingly, such that the mooring line 106 passes through the aperture in the cover 132 and that when a user pulls the mooring line 106 out of the housing 102, the mooring line 106 comes out of the lateral side of the housing 102, with stopper 112 being on the cover 132 when the mooring line 106 is in the retracted position.

The lock 108 has a pivot arm 150, a lever arm 152 connected to the pivot arm 150, a flexible arm 154 extending from the lever arm 152 behind the pivot arm 150, a hook 156 at the end of the flexible arm 154 and a tab 158 extending rearward from the flexible arm 154. The lock 108 also has a plurality of teeth 160 formed by a toothed member 162 connected to the pivot arm 150. In the present embodiment, the pivot arm 150, the lever arm 152, the flexible arm 154, the hook 156 and the tab 158 are integrally formed as a single part by plastic injection molding, while the toothed member 162 is molded from an elastomeric material. It is contemplated that the various parts of the lock 108 could be connected to each other in other ways.

Figure 11:
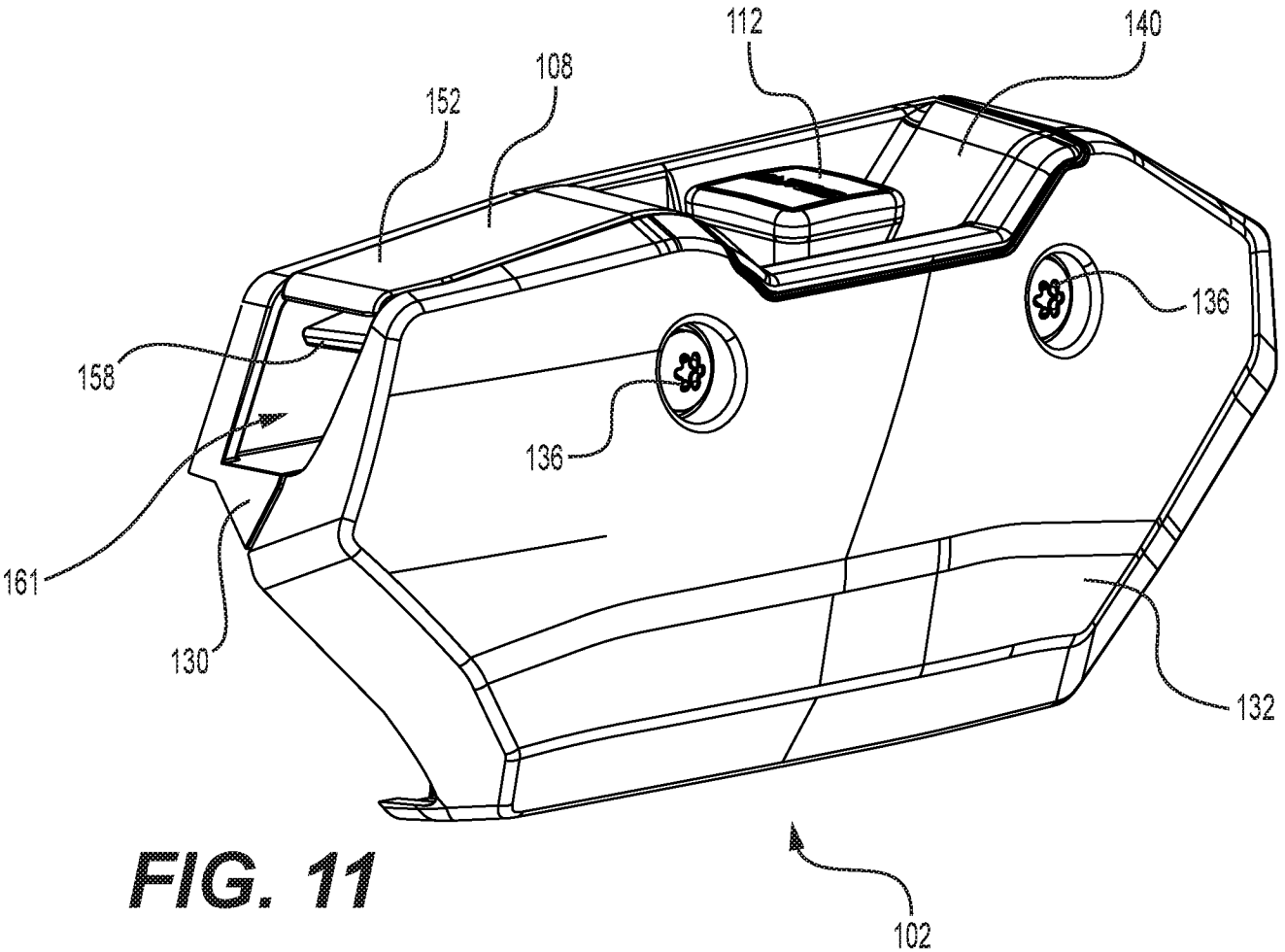
FIG. 11 is a perspective view taken from a rear, right side of the housing of FIG. 3 with the lock in a locked position and showing a stopper of the mooring line.

As can be seen in FIGS. 11, 12 and 14, when the lock 108 is in its locked position, the top of the lever arm 152 is flush with a top of the housing 102 rearward of the recess 140. In the locked position of the lock 108, the hook 156 engages a post 166 defined in the mount 130 thus providing the locking engagement necessary to keep the lock 108 locked. As can be seen in FIG. 14, in the locked position of the lock 108, the toothed member 162 and the teeth 160 press down on the part of the mooring line 106 inside the passage 146. As a result, this part of the mooring line 106 is squeezed between the wall 168 of the mount 130 defining the bottom of the passage 146 and the toothed member 162 and the teeth 160. The elastomeric toothed member 162 causes a biasing force to be applied to the part of the mooring line 106 engaged by the teeth 160. The teeth 160 are shaped and engage the mooring line 106 so as to prevent the mooring line 106 from being pulled out of the housing 102. As such, the lock 108 is a clamp that clamps the mooring line 106 against the housing 102. It is contemplated that other types of locks could be used. For example, the lock could be a cleat provided on the housing 102 or near it on the personal watercraft 10 around which the mooring line 106 could be tied in order to lock the mooring line 106 in position wither respect to the housing 102 and the rest of the watercraft 10.

Figure 13:
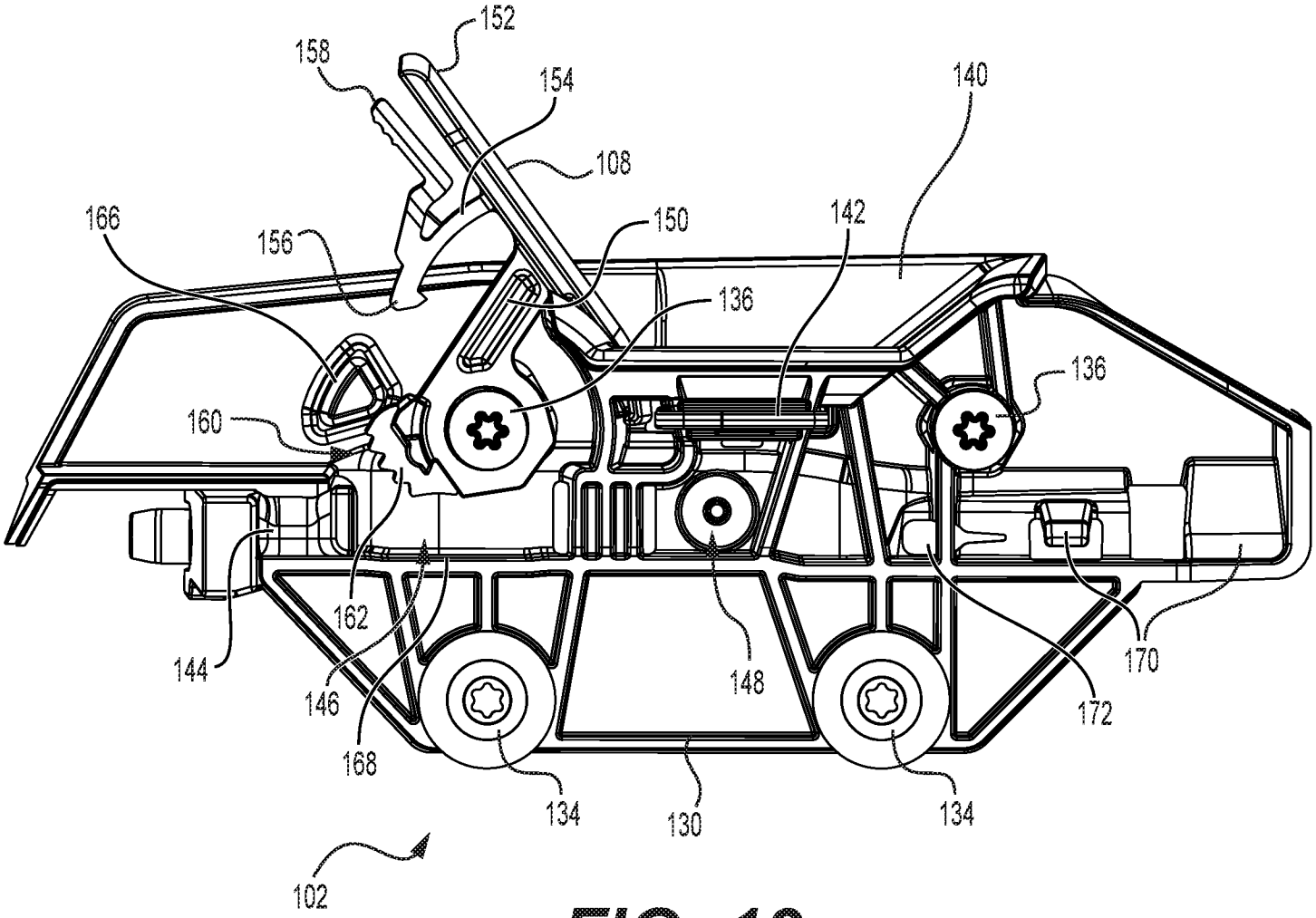
FIG. 13 is a right side elevation view of the components of FIG. 12 with the lock in the unlocked position.

To move the lock 108 to an unlocked position, a user accesses the tab 158 through a space 161 (FIG. 11) defined at the rear of the housing 102 and pushes the tab 158 toward the lever arm 152. As a result, the flexible arm 154 deforms and causes the hook 156 to disengage the post 166. The lock 108 can then be pivoted upward about the rear boss 138 as shown in FIG. 13. In this position, the teeth 160 and the toothed member 162 no longer engage the mooring line 106 which can then be pulled in or out of the housing 102.

To move the lock 108 back to the locked position, the user simply needs to pivot the lock 108 back down. The hook 156 and the post 166 have angled surfaces that, when they abut each other, causes the flexible arm 154 to deflect as the lock 108 is being pivoted down. Once the hook 156 goes past the post 166, the forces resulting from the deflection of the flexible arm 154 return the flexible arm 154 to its original position and cause the hook 156 to engage the post 166. As such, the user does not need to move the tab 158 toward the lever arm 152 to place the lock 108 into the locked position.

The mount 130 further defines guides 170 and an anchor 172 at a front thereof. The elastic line 104 of the rear mooring line assembly 100 is guided in the housing 102 by the guides 170 and is connected to the housing 102 by the anchor 172.

Figure 15:
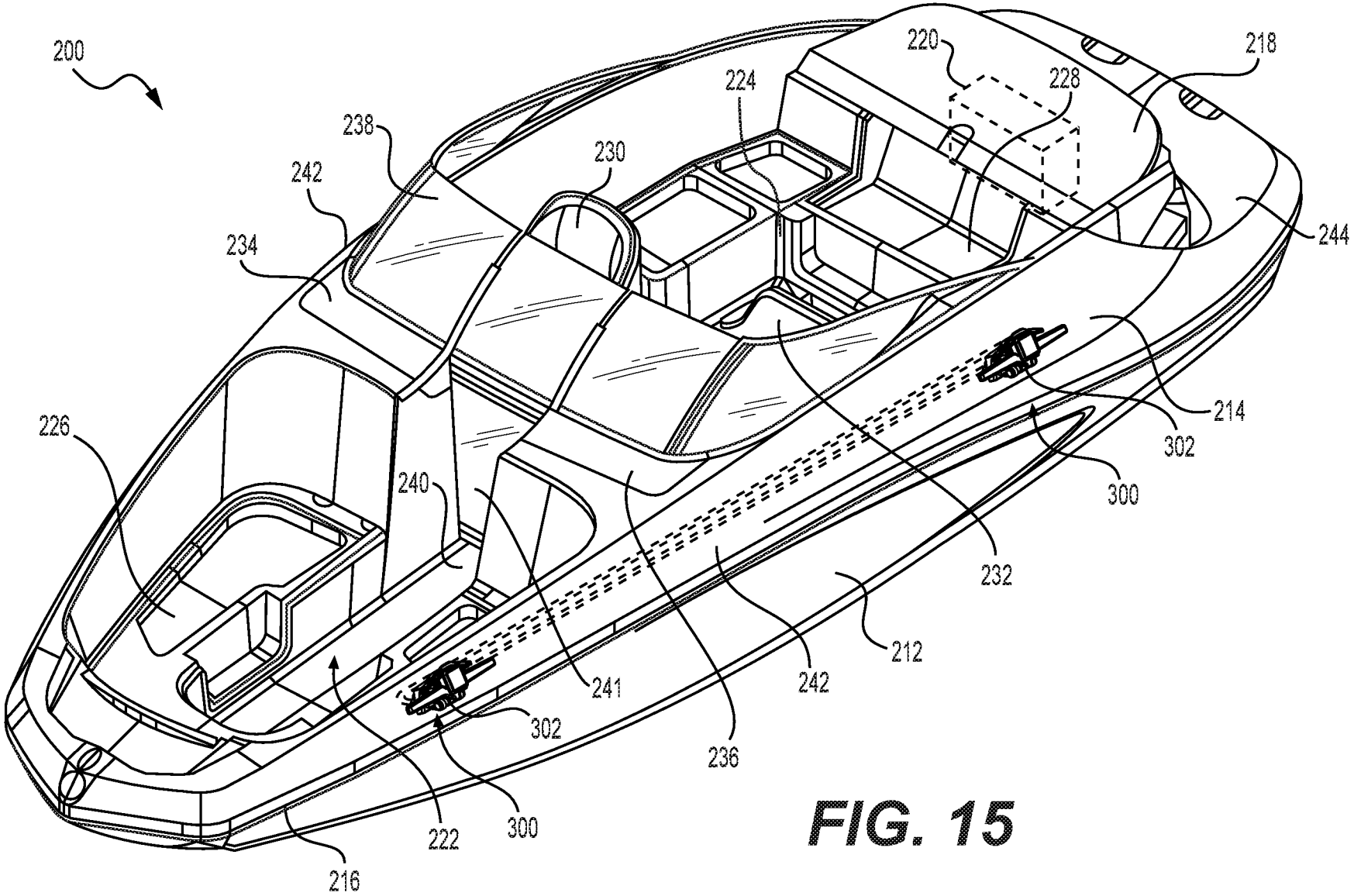
FIG. 15 is a perspective view taken from a front, left side of a boat provided with alternative embodiments of front and rear mooring line assemblies.

Turning now to FIG. 15, the general construction of the boat 200 in accordance with the present technology is shown. The following description relates to one way of manufacturing a boat. Those of ordinary skill in the watercraft art will recognize that there are other known ways of manufacturing and designing boats and that this technology would encompass these other known ways and designs.

The boat 200 of FIG. 15 has a hull 212 and a deck 214. The hull 212 buoyantly supports the boat 200 in the water. The deck 214 is designed to accommodate a driver and multiple passengers. It is contemplated that the deck 14 could be designed to accommodate only the driver or only the driver and more or less passengers. The deck 214 sits on top of hull 212 and they are connected to each other in a sealing relationship. The hull 212 and the deck 214 are connected by an adhesive, but other known joining methods could be used to connect the hull 212 and deck 214 together, including but not limited to thermal fusion or fasteners such as rivets or screws. A bumper 216 generally covers the connection between the hull 212 and the deck 214 which helps to prevent damage to the outer surface of the boat 200 when the boat 200 is docked, for example.

A rear platform 218 is provided on the deck 214. A motor compartment is defined under the rear platform 218 and is accessible by lifting the rear platform 218. The motor compartment houses a motor, which in the present embodiment is an internal combustion engine 220 (shown schematically in FIG. 15).

The deck 214 has front and rear passenger areas 222, 224. The front passenger area has a number of passenger seats 226 arranged in a U-shape. The rear passenger area 224 has a number of passenger seats 228 arranged in a U-shape. The rear passenger area 224 also has a driver seat 230 and a passenger seat 232. The driver seat 230 is located behind a driver console 234 and the passenger seat 232 is located behind a passenger console 236. The driver console 234 support a steering wheel (not shown) of the boat 200. Other boat controls, such as a throttle control, and displays are also supported by the driver console 234 or are provided near the driver console 234. A windshield 238 is provided on top of the consoles 234, 236 in front of the driver and passenger seats 230, 232. A passage 240 is provided between the consoles 234, 236 to provide communication between the front and rear passenger areas 222, 224. A door 241 and a central portion of the windshield 238 selectively close the passage 240.

The deck 214 has a pair of gunwales or gunnels 242. A reboarding platform 244 is provided at the rear of the deck 214 to allow the rider or a passenger to easily reboard the boat 200 from the water.

The boat 200 is propelled by a jet propulsion system (not shown) similar to the jet propulsion system of the personal watercraft 10 described above. The boat 200 is also provided with a reverse gate, such as the reverse gate 72 of the personal watercraft 10 discussed above. As such, the jet propulsion system and reverse gate of the boat 200 will not be described in detail herein. It is contemplated that the boat 200 could be propelled by a marine propulsion system other than the jet propulsion system, such as a stern drive, an inboard motor or an outboard motor for example.

As can be seen in FIG. 15, the boat 200 is provided with front and rear mooring line assemblies 300. It is contemplated that only one of the front and rear mooring line assemblies 300 may be provided. It is also contemplated that more than two mooring line assemblies 300 could be provided. As will be described in greater detail below, and with reference to FIGS. 16 to 27, each mooring line assembly 300 includes a housing 302, an elastic line 304, a mooring line 306, a lock 308, a connector 310, a stopper 312, a front pulley 314 and a rear pulley 316. The elastic lines 304 are made from bundles of rubber strands surrounded by a woven sheath. Other types of elastic lines are contemplated. In some embodiments, each elastic line 304 can be stretched up to three times its original unstretched length.

As can be seen in FIG. 15, the housings 302 of both mooring line assemblies 300 are connected to the deck 214 on an outer surface of the port gunnel 242, with the housing 302 of the front mooring line assembly 300 being disposed forward of the housing 302 of the rear mooring line assembly 300. It is contemplated that in some embodiments, one or both housings 302 could be connected on the hull 212 or elsewhere on the deck 214. For example, it is contemplated that both housings 102 could be connected to the starboard gunnel 242. In the present embodiment, the housings 302 are fastened to the port gunnel 242. However, it is contemplated that the housings 302 could be connected to the boat 200 by other means.

A front bracket 318 is connected inside the cavity between the hull 212 and the deck 214. The front bracket 318 is generally longitudinally aligned with the housing 302 of the front mooring line assembly 300. A shaft 320 is connected to the front bracket 318. The front pulleys 314 are rotationally mounted on the shaft 320, with the front pulley 314 of the rear mooring line assembly 300 being on top of the front pulley 314 of the front mooring line assembly 300.

A rear bracket 322 is connected inside the cavity between the hull 212 and the deck 214. The rear bracket 322 is generally longitudinally aligned with the housing 302 of the rear mooring line assembly 300. A shaft 324 is connected to the rear bracket 322. The rear pulleys 316 are rotationally mounted on the shaft 324, with the rear pulley 316 of the rear mooring line assembly 300 being on top of the rear pulley 316 of the front mooring line assembly 300.

For each mooring line assembly 300, one end of the elastic line 304 is connected to one end of the mooring line 306 via the connector 310, and the other end of the mooring line 306 is connected to the stopper 312. The connector 310 is similar to the connectors 110 of the mooring line assemblies 100 described above. For each mooring line assembly 300, the combination of the elastic line 304 and the mooring line 306 defines what is referred to herein as a combined line 326.

For the front mooring line assembly 300, one end of the elastic line 304 is connected to the front bracket 318. From the front bracket 318, the combined line 326 extends longitudinally rearward, wraps around and engages a portion of the lower one of the rear pulleys 316, then extends longitudinally forward, wraps around and engages a portion of the lower one of the front pulleys 314, then extends through the front bracket 318 and the deck 214. From there, the mooring line 306 extends through the housing 302.

For the rear mooring line assembly 300, one end of the elastic line 304 is connected to the rear bracket 322. From the rear bracket 322, the combined line 326 extends longitudinally forward, wraps around and engages a portion of the upper one of the front pulleys 314, then extends longitudinally rearward, wraps around and engages a portion of the upper one of the rear pulleys 316, then extends through the rear bracket 322 and the deck 214. From there, the mooring line 306 extends through the housing 302.

It is contemplated that the combined line 326 of the front mooring line assembly 300 could engage the upper pulleys 314, 316 and that the combined line 326 of the rear mooring line assembly 300 could engage the lower pulleys 314, 316.

A pair of guides 328 is connected inside the cavity defined between the hull 212 and the deck 214 longitudinally between the brackets 318, 322. The combined lines 326 pass through the guides 328 which assist in maintaining the combined lines 326 properly aligned.

Figure 20:
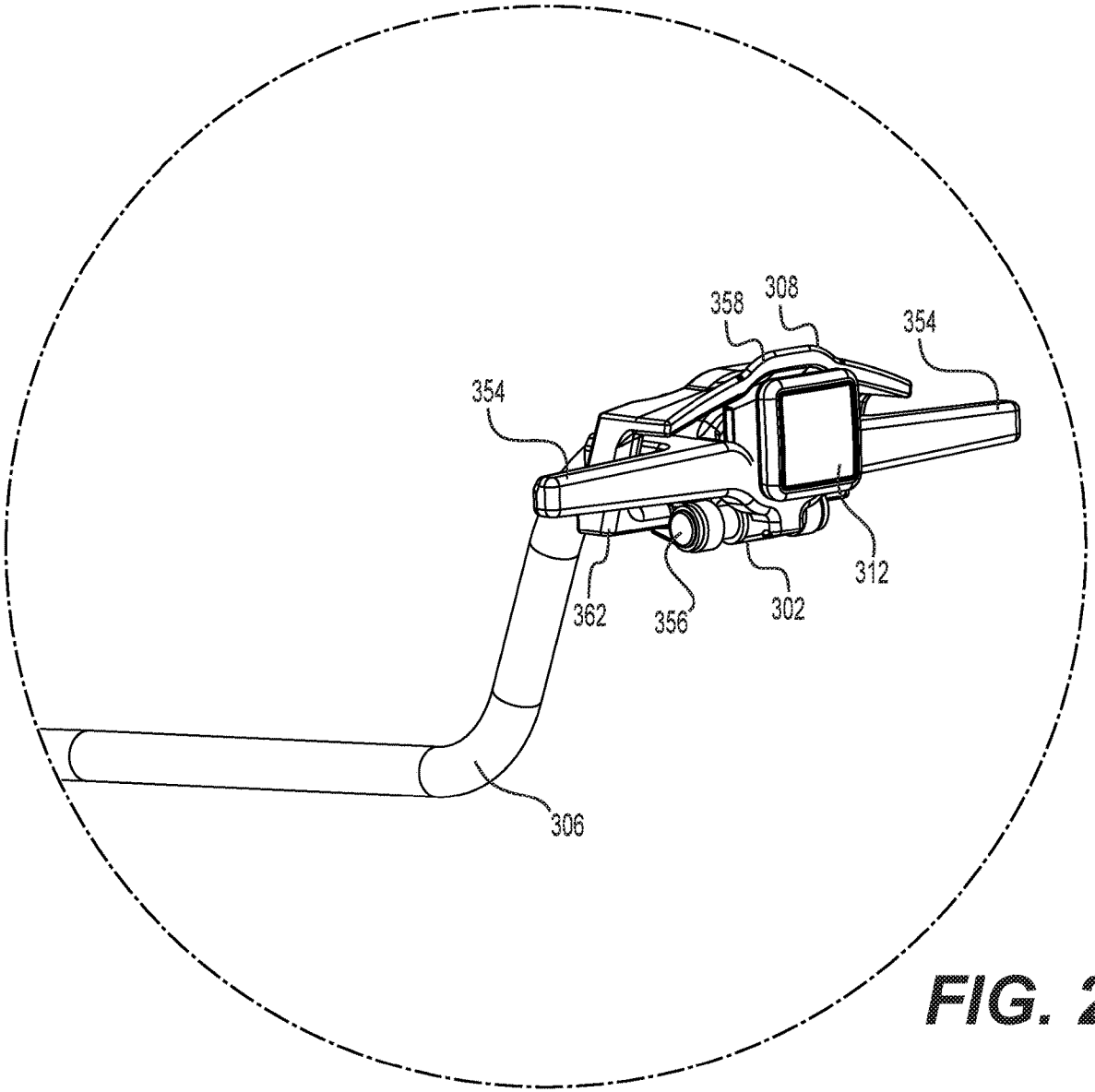
FIG. 20 is a close-up view of portion D of FIG. 16.
Figure 21:
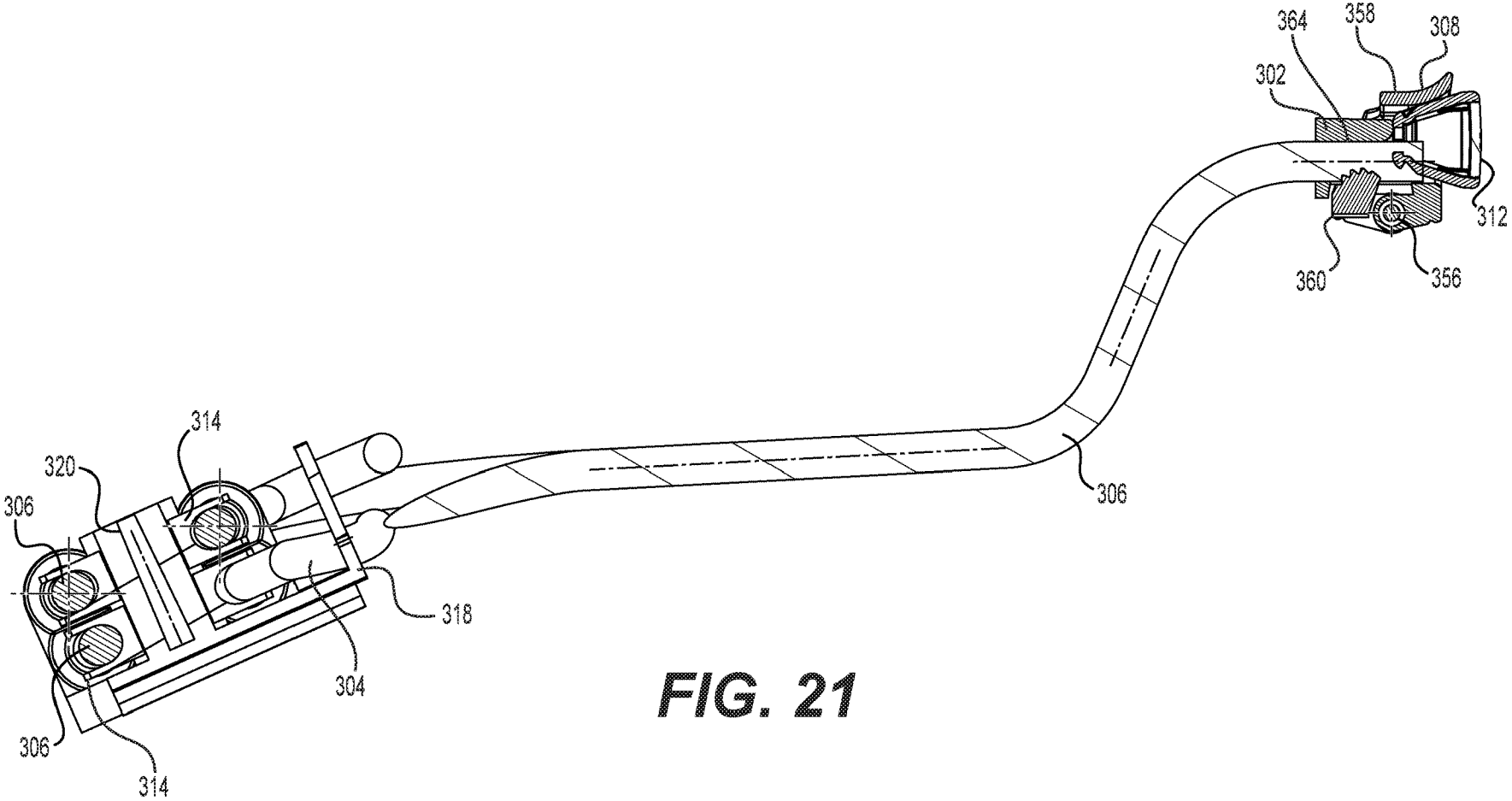
FIG. 21 is a cross-sectional view of the mooring line assemblies of FIG. 16 taken through line 21-21 of FIG. 19.
Figure 22:
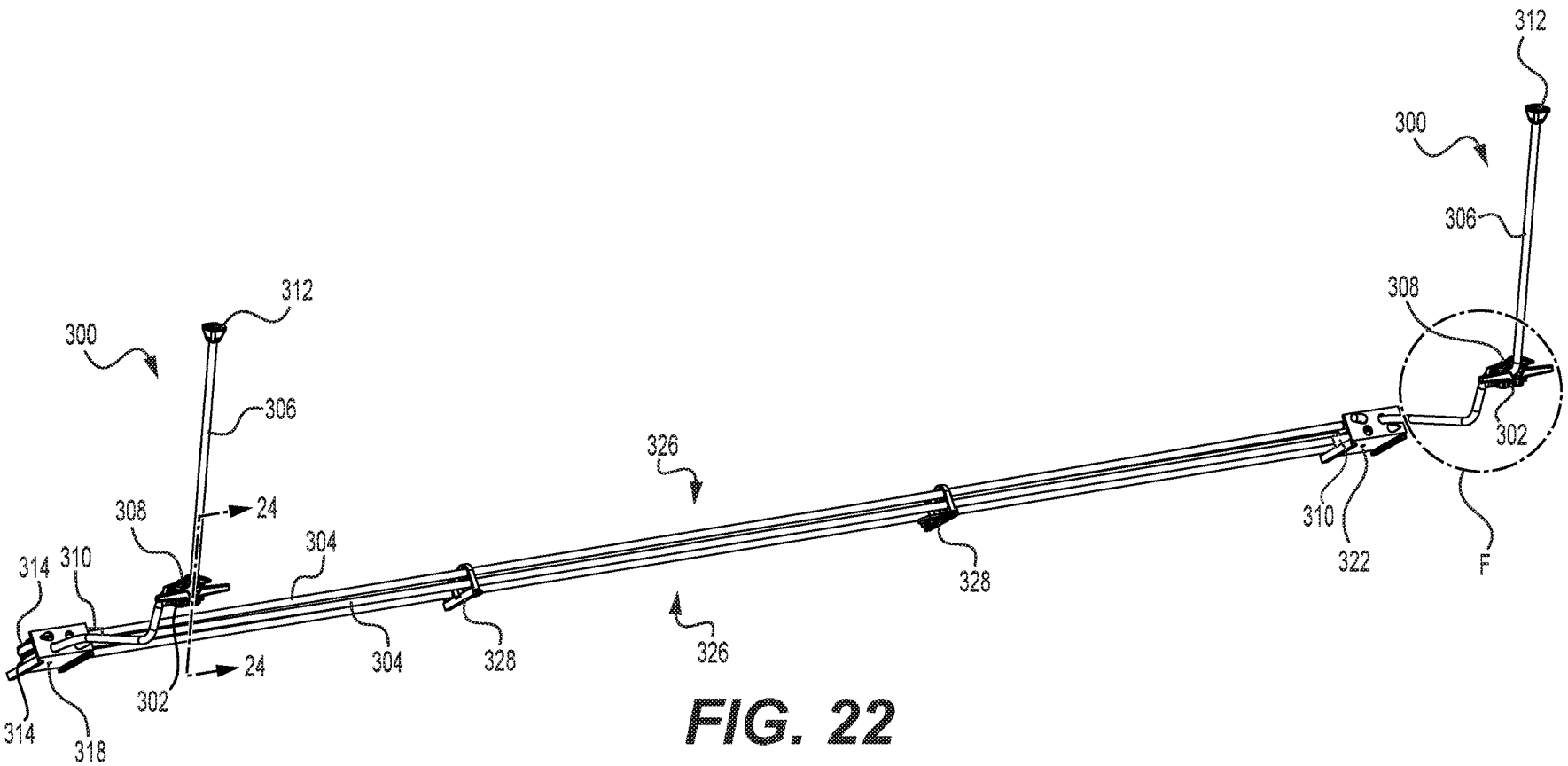
FIG. 22 is a perspective view taken from a front, left side of the mooring line assemblies of the boat of FIG. 15, with the mooring lines in extended positions and the locks in unlocked positions.
Figure 23:
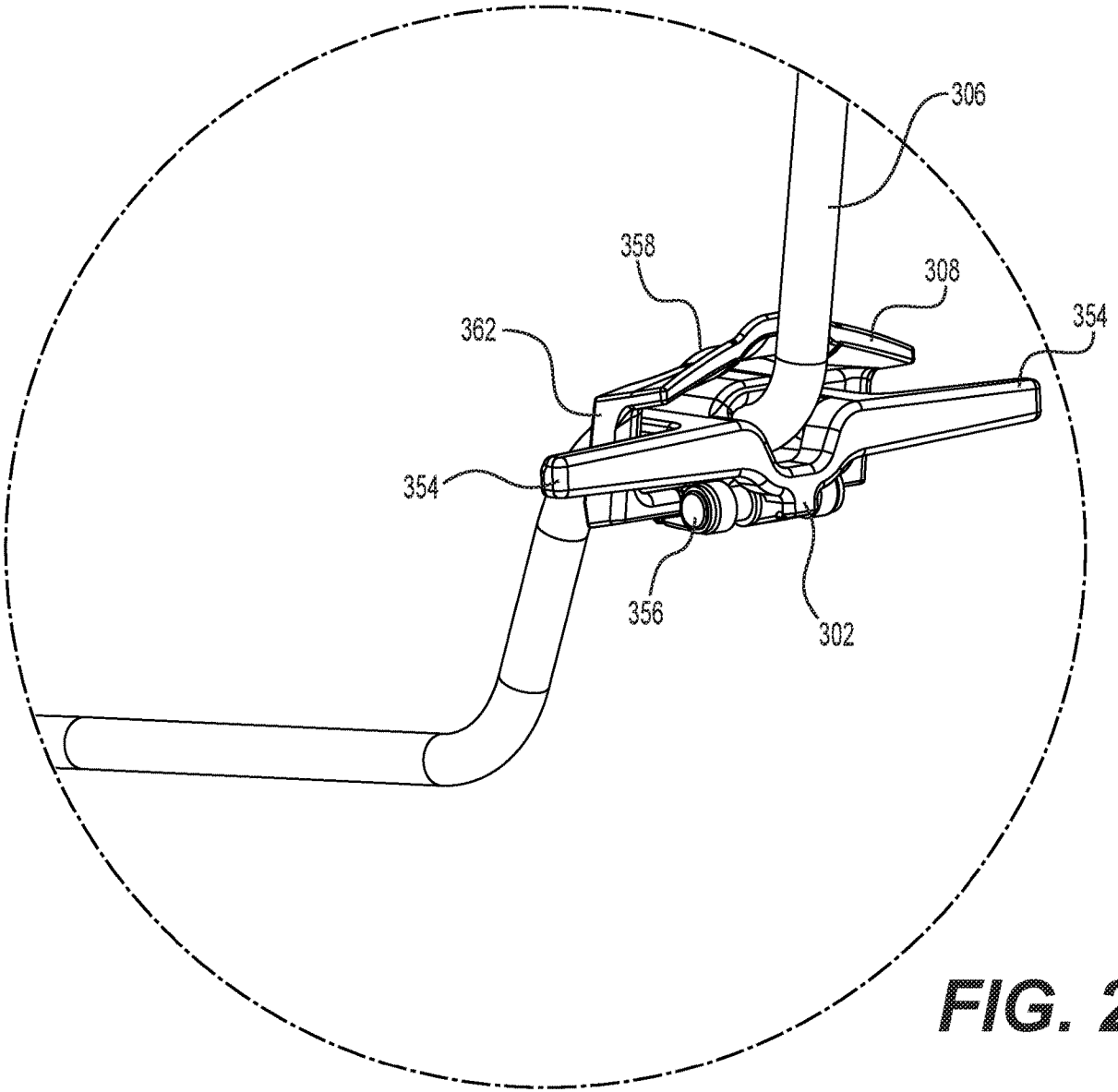
FIG. 23 is a close-up view of portion F of FIG. 22.
Figure 24:
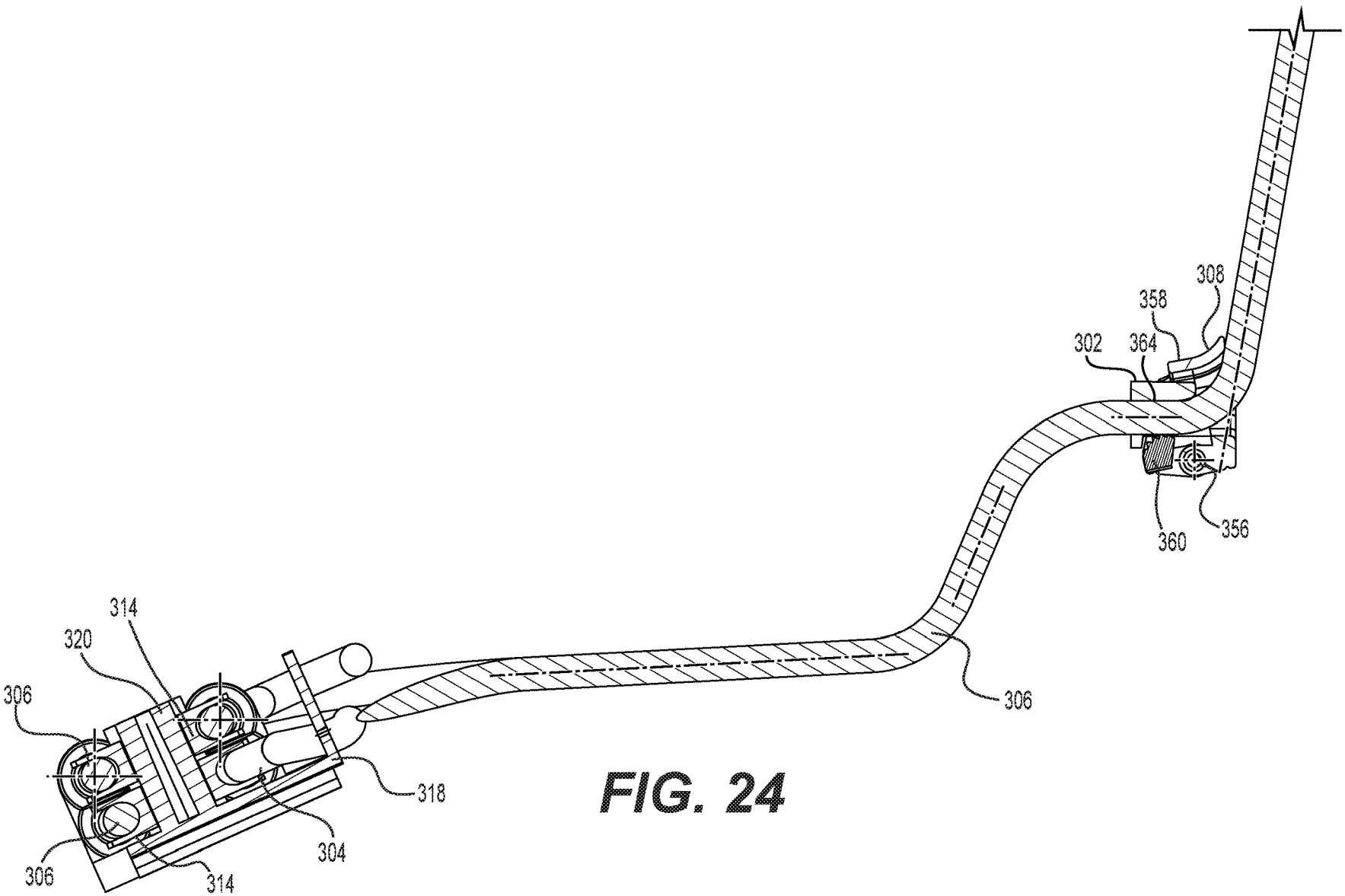
FIG. 24 is a cross-sectional view of the mooring line assemblies of FIG. 22 taken through line 24-24 of FIG. 22.
Figure 25:
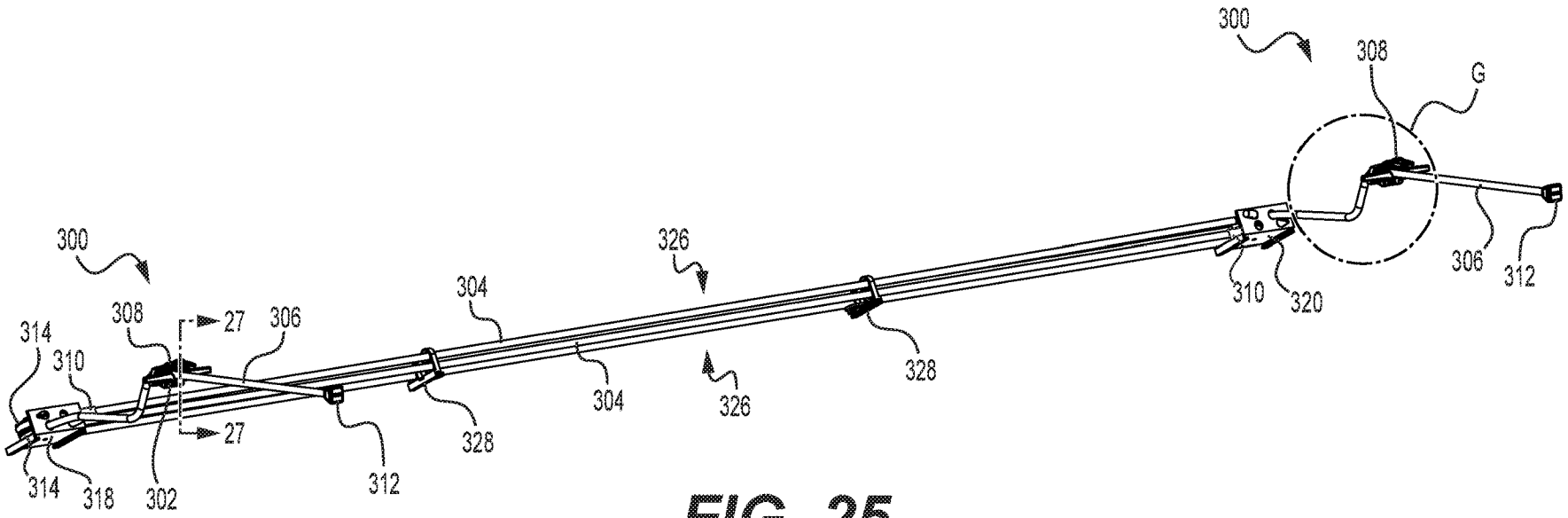
FIG. 25 is a perspective view taken from a front, left side of the mooring line assemblies of the boat of FIG. 15, with the mooring lines in extended positions and the locks in locked positions.
Figure 26:
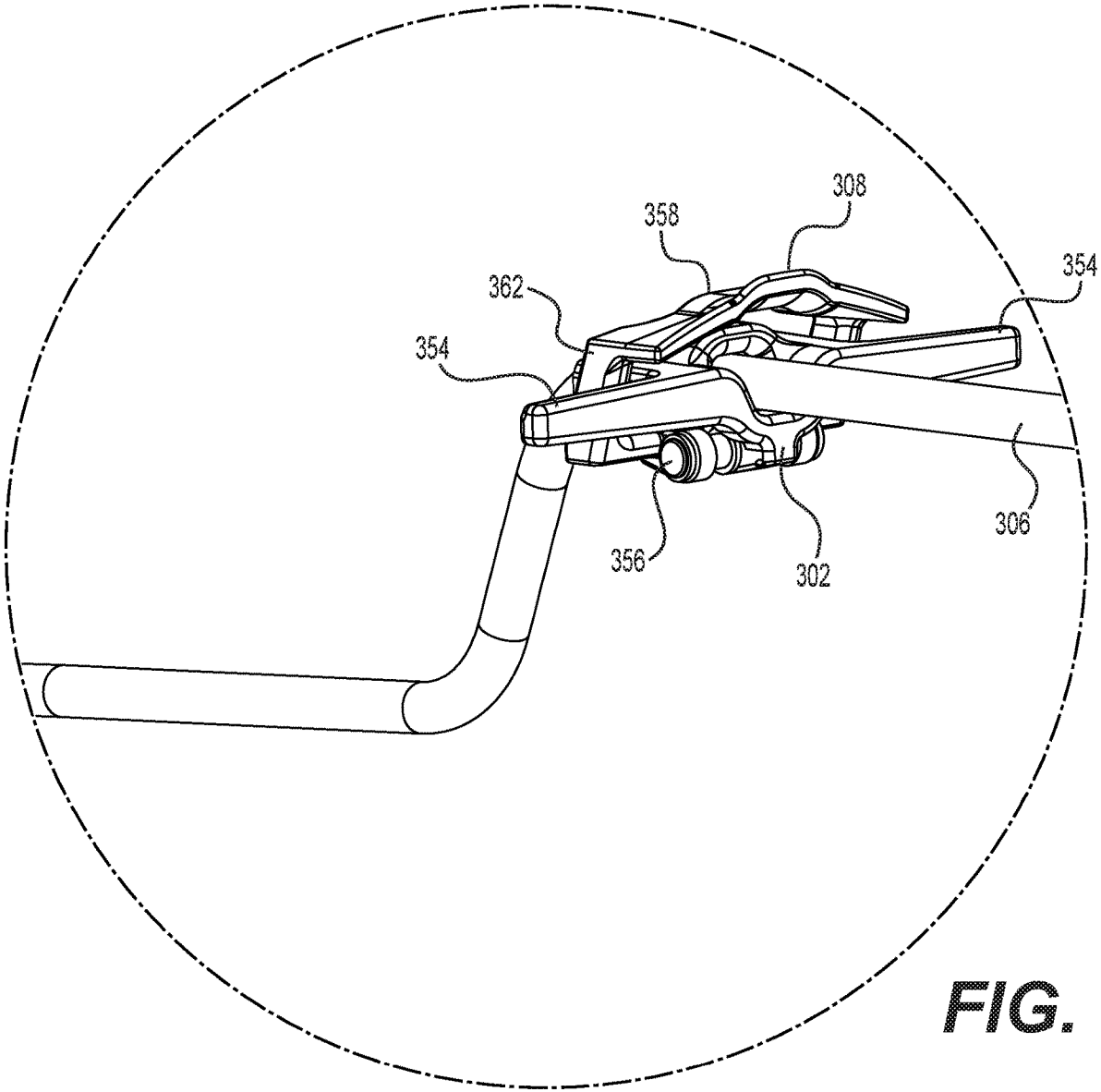
FIG. 26 is a close-up view of portion G of FIG. 25.
Figure 27:
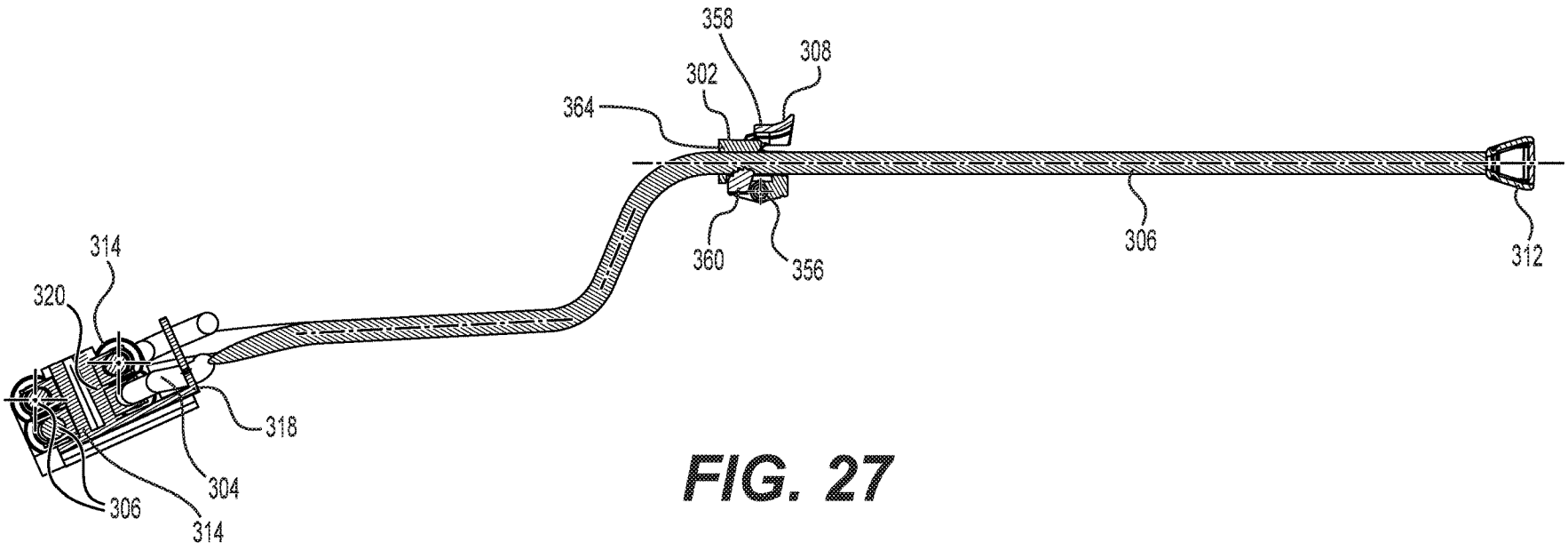
FIG. 27 is a cross-sectional view of the mooring line assemblies of FIG. 25 taken through line 27-27 of FIG. 25.

For each of the mooring line assemblies 300, when the lock 308 is in an unlocked position as shown in FIGS. 22 to 24, the mooring line 306 can be pulled out of the housing 302 in a plurality of extended positions until a sufficient length of mooring line 306 is available to connect the mooring line 306 to a mooring. Pulling the mooring line 306 out of the housing 302 stretches the elastic line 304. To prevent the mooring line 306 from being pulled back through the housing 302 by the elastic line 304, the lock 308 is put into a locked position as shown in FIGS. 25 to 27 so as to cooperate with the mooring line 306 to lock the mooring line 306 in the desired extended position. The length of mooring line 306 extending out of the housing 302 can then be connected to a mooring. Putting the lock 308 in the locked position also prevents forces resulting from the connection of the mooring line 306 to a mooring from being transmitted to the elastic line 304. When the mooring line 306 is disconnected from the mooring, the lock 308 is put back in the unlocked position and the elastic line 304 contracts and pulls the mooring line 306 back through the housing 302. The stopper 312 prevents the mooring line 306 from being pulled completely through the housing 102. The position at which the stopper 312 engages the housing 302 and stops the mooring line 306 when the lock 308 is in the unlocked position is referred to as the retracted position of the mooring line 306. Once the mooring line 306 is in the retracted position, the lock 308 can be put in the locked position again as shown in FIGS. 16 to 21.

For each mooring line assembly 300, in order to prevent the mooring line 306 from being pulled too far through its housing 302, which could result in the elastic line 304 being engaged by the lock 308 instead of the mooring line 306, a stopper (not shown, but corresponding to the stopper 114 described above) is connected to the connector 310. This stopper is too big to pass through the housing 302. The position at which this stopper engages the housing 302 and stops the mooring line 306 from being pulled any further out of the housing 302 is referred to as the maximum extended position of the mooring line 306. The maximum extended position of the mooring line 306 is the extended position of the mooring line 306 with the greatest length of mooring line 306 available to connect the mooring line 306 to a mooring. It is contemplated that this stopper could be an element separate from the connector 310 and connected to the mooring line 306 near the connector 310.

Figure 16:
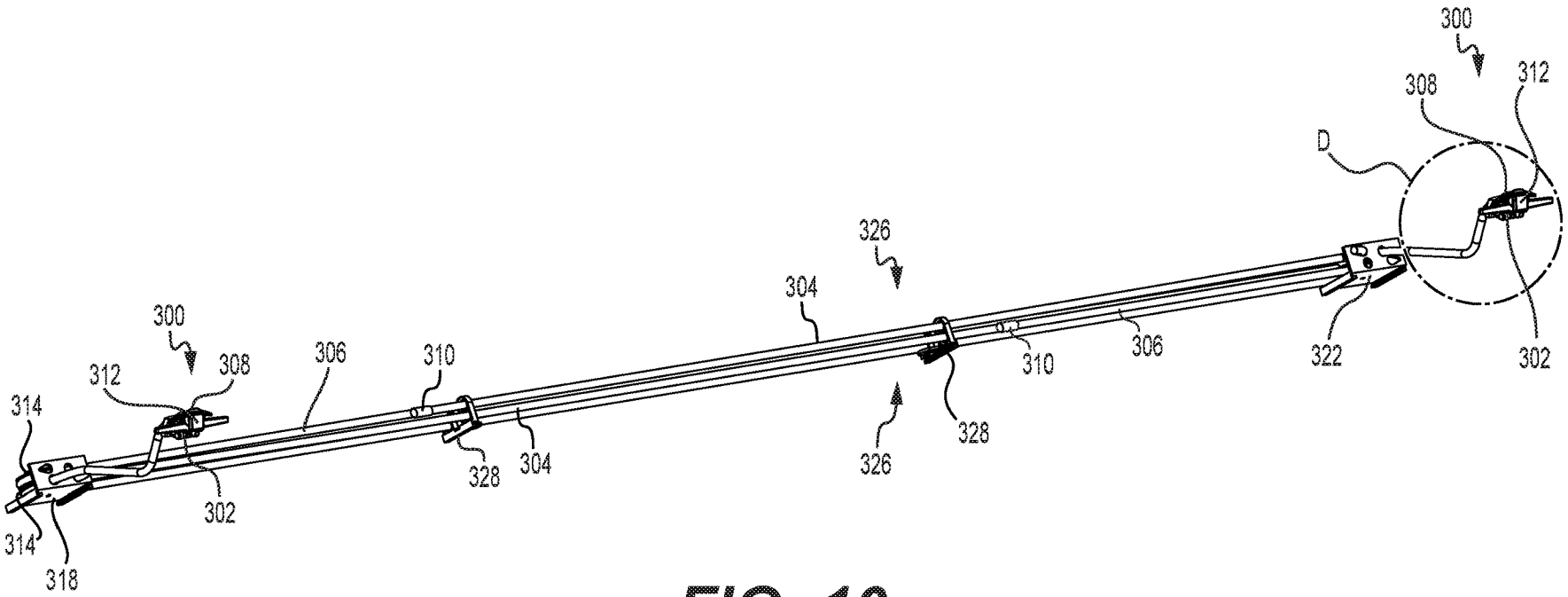
FIG. 16 is a perspective view taken from a front, left side of the mooring line assemblies of the boat of FIG. 15, with the mooring lines in retracted positions and the locks in locked positions.
Figure 17:
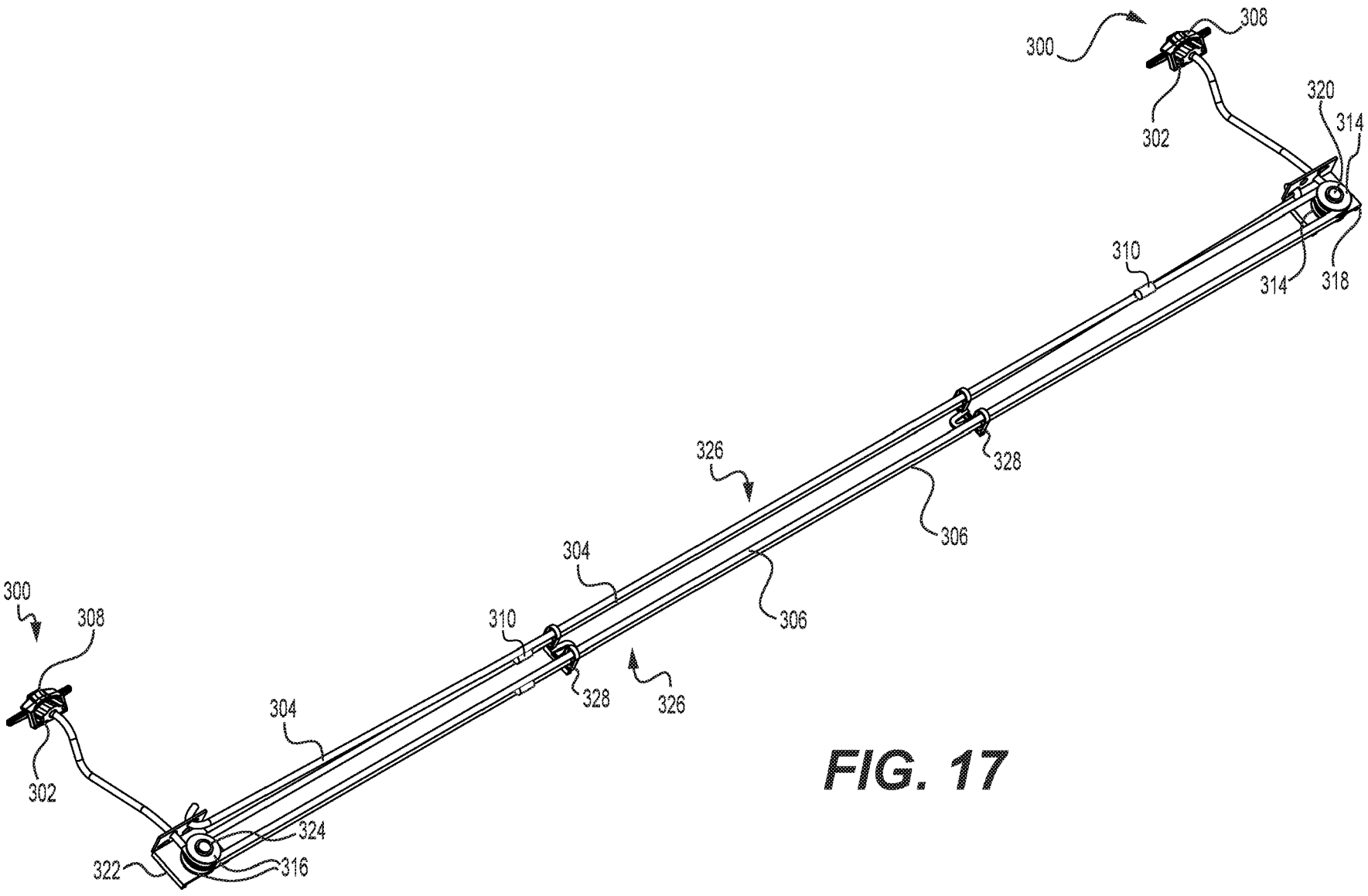
FIG. 17 is a perspective view taken from a rear, right side of the mooring line assemblies of FIG. 16.
Figure 18:
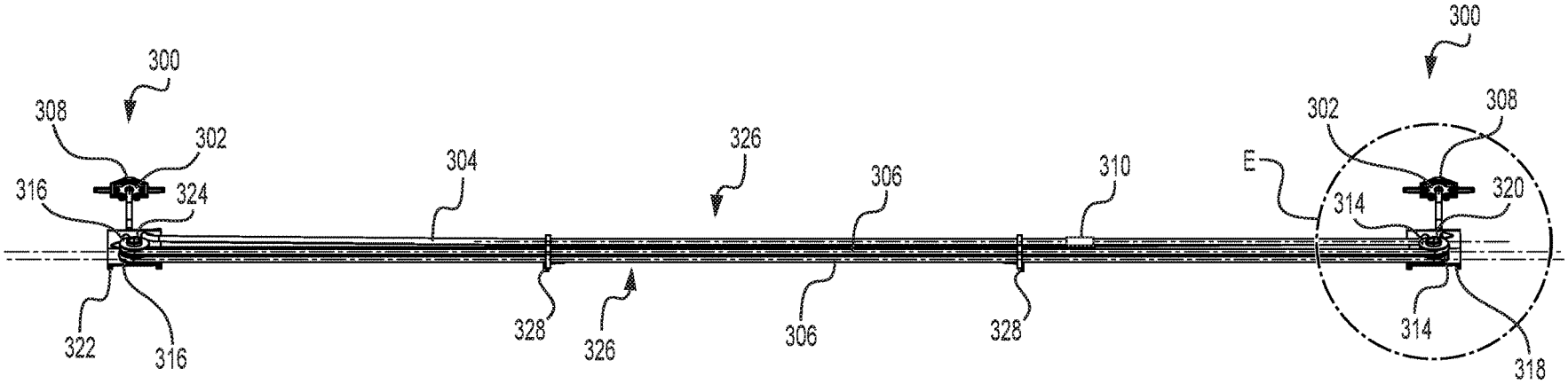
FIG. 18 is a right side elevation view of the mooring line assemblies of FIG. 16.

In the retracted position of the mooring lines 306, the entire elastic lines 304 and a majority of each of the mooring lines 306 is disposed inside the cavity defined between the hull 212 and the deck 214. As can be seen in FIG. 16, in the retracted position of the mooring lines 306, a part of the mooring line 306 of the rear mooring line assembly 300 overlaps the elastic line 304 of the front mooring line assembly 300, and the elastic line 304 of the rear mooring line assembly 300 overlaps a part of the mooring line 306 of the front mooring line assembly 300.

With reference to FIGS. 16 to 21, for each mooring line assembly 300, in the retracted position of the mooring line 306 as shown, the elastic line 304 has a length that is less than a length of the portion of the mooring line 306 extending between the connector 310 and the housing 302 and less than the overall length of the mooring line 306. In the present embodiment, this length of the elastic line 304 is about half the overall length of the mooring line 306. Although the mooring line 306 is not pulled out of the housing 302 in this position, the elastic line 304 is nonetheless in tension so as to keep the mooring line 306 in tension, however it is contemplated that this need not be the case. When the mooring line 306 is pulled through the housing 302 to any one of its extended positions, such as the position shown in FIG. 22, the elastic line 304 is stretched and therefore has a length greater than its length in the retracted position and, since part of the mooring line 306 extends out of the housing 302, the portion of the mooring line 306 extending between the connector 310 and the housing 302 has a length that is less than the length of the portion of the mooring line 306 extending between the connector 310 and the housing 302 in the retracted position. When the mooring line 306 is at its maximum extended position of the plurality of extended positions, the length of the elastic line 304 is greater than the overall length of the mooring line 306. In the present embodiment, the length of the elastic line 304 when the mooring line 306 is in its maximum extended position is about one and a half times the overall length of the mooring line 306.

Both mooring line assemblies 300 have identical housings 302, locks 308 and stopper 312. These will be described in more detail with reference to FIGS. 19, 20, 21 23, 24, 26 and 27. It is contemplated that the housing 302, the lock 308 and/or stopper 312 of one of the mooring line assemblies 300 could differ from the housing 302, the lock 308 and the stopper 312 respectively of the other one of the mooring line assemblies 300.

Figure 19:
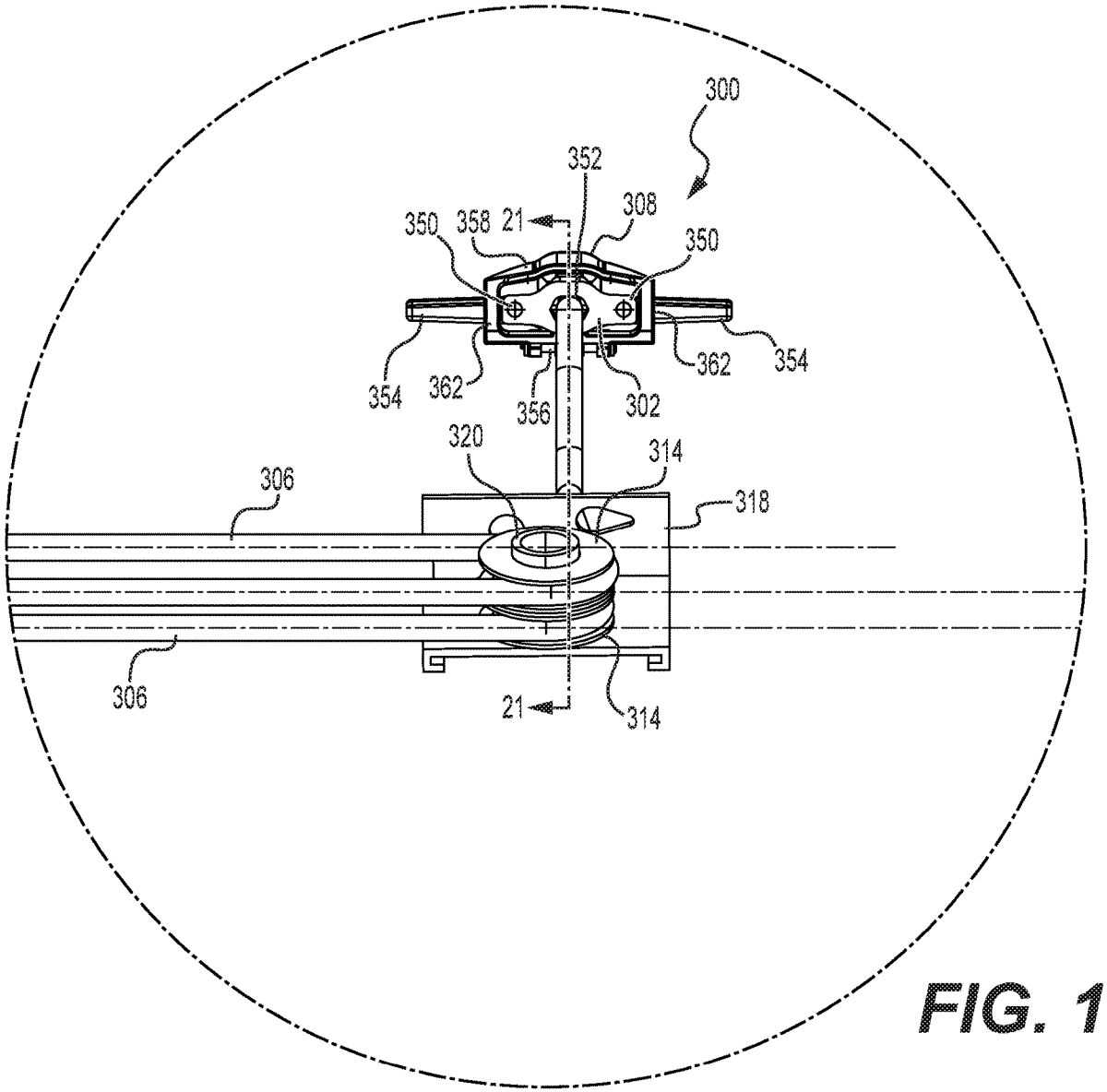
FIG. 19 is a close-up view of portion E of FIG. 18.

As can be seen in FIG. 19, the housing 302 has a pair of apertures 350 through which fasteners (not shown) are inserted to connect the housing 302 to the deck 214. Another aperture 352 is defined between the two apertures 350. The mooring line 306 is inserted into the housing 302 via this aperture 352. The housing 302 also defines a pair of arms 354 which together define a cleat. This cleat can be used to tie the mooring line 106 in order to lock the mooring line 106 in position in addition to or instead of the lock 308. This cleat can also be used to tie mooring lines other than those provided in the mooring line assemblies 300.

The lock 308 is pivotally connected to the housing 302 by a pin 356. The lock 308 includes a top lever arm 358, a lower toothed arm 360 (see FIG. 21) and a pair of side arms 362 connecting the top lever arm 358 to the lower toothed arm 360. A portion of the housing 302 is received inside the perimeter defined by the top lever arm 358, the lower toothed arm 360, and the side arms 362. The mooring line 306 also extends through this perimeter. As can be seen in FIG. 20, when the mooring line assembly 300 is in the retracted positions, the stopper 312 is received in a receptacle defined between the housing 302 and the top lever arm 358. As can be seen in FIG. 21, the stopper 312 has sides that taper.

As can be seen in FIGS. 21 and 27, in the locked position of the lock 308, the teeth of the toothed arm 360 press down on the part of the mooring line 306 passing through the housing 302. As a result, this part of the mooring line 306 is squeezed between a wall 364 of the housing 302 and the toothed arm 360. The teeth of the toothed arm 360 are shaped and engage the mooring line 306 so as to prevent the mooring line 306 from being pulled out of the housing 302. As such, the lock 308 is a clamp. It is contemplated that other types of locks could be used.

To move the lock 308 to an unlocked position, a user pushes the lever arm 358 up. As a result, the lock 308 is pivoted upward about the pin 356 as shown in FIGS. 23 and 24. In this position, the teeth of the toothed arm 360 no longer engage the mooring line 306 which can then be pulled in or out of the housing 302. To move the lock 308 back to the locked position, the user simply needs to push the lever arm 358 back down until the toothed arm 360 engages the mooring line 306.

In an alternative embodiment, it is contemplated that a mooring line assembly 300 could be provided without the pulleys 314, 316 or with only one of the pulleys 314, 316. In an alternate embodiment, it is contemplated that the mooring line assemblies 300 could be provided in mooring system that could be fastened as a unit to the boat 200. In such a mooring system, a case is provided that defines a cavity. The brackets 318, 322, shafts 320, 324, pulleys 314, 316 and guides 328 are provided in the cavity of this case in the same arrangement as shown in the figures above. The housings 302 are mounted to the outside of the case. The combined lines 326 are routed inside the cavity of the case and through the housings 302 in the same manner as shown in the figures above. Thus the mooring system can attached to the side of a watercraft without having to install components inside the cavity between the hull and the deck which could be difficult in some boat.

In an alternative embodiment of the mooring line assembly 300, which is not shown herein, the lock 308 is omitted, and all other features of this alternative embodiment are similar to those of the mooring line assembly 300. As there is no lock 308, the mooring line 306 can be readily pulled out of the housing 302 in a plurality of extended positions until a sufficient length of mooring line 306 is available to connect the mooring line 306 to a mooring. Pulling the mooring line 306 out of the housing 302 stretches the elastic line 304. The length of mooring line 306 extending out of the housing 302 can then be connected to a mooring. Once the mooring line 306 is connected to the mooring, the elastic line 304 maintains the mooring line 306 in tension between the mooring and the housing 302. To lock the mooring line 306 in the desired extended position, the mooring line 306 is tied to the cleat defined by the arms 354 which act as the lock in the present embodiment. This also prevents forces resulting from the connection of the mooring line 306 to a mooring from being transmitted to the elastic line 304. When the mooring line 306 is disconnected from the mooring, the mooring line 306 is untied from the cleat defined by the arms 354 and the elastic line 304 contracts and pulls the mooring line 306 back through the housing 302. The stopper 312 prevents the mooring line 306 from being pulled completely through the housing 102.

It is contemplated that the mooring line assemblies 300 of the boat 200 could be replaced by mooring line assemblies similar to the mooring line assemblies 100 described above. Similarly, it is contemplated that the mooring line assemblies 100 of the personal watercraft 10 could be replaced by mooring line assemblies similar to the mooring line assemblies 300 described above.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A mooring line assembly for a watercraft, the watercraft defining at least one of a recess and a cavity, the mooring line assembly comprising:

an elastic line having a first end and a second end, the first end of the elastic line being adapted for connection to the watercraft;

a mooring line having a first end and a second end, the first end of the mooring line being connected to the second end of the elastic line; and a housing adapted for connection to the watercraft, the mooring line extending through the housing, the mooring line being pullable through the housing from a retracted position to a plurality of extended positions, in the retracted position, when the mooring line assembly is provided on the watercraft, the elastic line and a majority of the mooring line being disposed in the at least one of the recess and the cavity, in the retracted position:

the elastic line has a first length, and a portion of the mooring line extending from the first end of the mooring line to the housing has a second length;

in any one of the plurality of extended positions:

the elastic line has a third length, the third length being greater than the first length, and the portion of the mooring line extending from the first end of the mooring line to the housing has a fourth length, the fourth length being less than the second length; and the elastic line being adapted for returning the mooring line to the retracted position from the plurality of extended positions.

2. The mooring line assembly of claim 1, further comprising a lock cooperating with the mooring line for locking the mooring line in any one of the plurality of extended positions.

3. The mooring line assembly of claim 2, wherein the lock is connected to the housing.

4. The mooring line assembly of claim 3, wherein the lock is a clamp pivotally connected to the housing.

5. The mooring line assembly of claim 1, further comprising a stopper connected to one of the mooring line and the elastic line at a position between the housing and the first end of the elastic line when the mooring line is in the retracted position; and wherein the stopper engages the housing when the mooring line is at a maximum extended position of the plurality of extended positions for preventing the mooring line from being pulled out further from the housing.

6. The mooring line assembly of claim 5, further comprising a connector connecting the second end of the elastic line to the first end of the mooring line; and wherein the stopper is connected to the connector.

7. The mooring line assembly of claim 1, further comprising an anchor provided in the housing for connecting an end of an elastic line of another mooring line assembly.

8. The mooring line assembly of claim 1, further comprising a stopper connected to the second end of the mooring line; and wherein the stopper engages the housing when the mooring line is at the retracted position for preventing the mooring line from passing through the housing.

9. The mooring line assembly of claim 1, wherein the first length is less than an overall length of the mooring line.

10. The mooring line assembly of claim 9, wherein, when the mooring line is at a maximum extended position of the plurality of extended positions, the third length is greater than the overall length of the mooring line.

11. The mooring line assembly of claim 1, further comprising a pulley;

wherein a combination of the elastic line and the mooring line defines a combined line; and wherein the combined line extends from the first end of the elastic line to the pulley, then engages a portion of the pulley, and then extends from the pulley to the housing.

12. A watercraft comprising:

a hull;

a deck connected to the hull; and a mooring line assembly according to claim 1 connected to at least one of the hull and the deck.

13. The watercraft of claim 12, wherein the at least one of the recess and the cavity is defined at least partially about an outer surface of the watercraft.

14. The watercraft of claim 12, wherein:

the hull has a lip;

the deck has a lip connected to the lip of the hull; and the at least one of the recess and the cavity is defined at least partially by at least one of the lips.

15. The watercraft of claim 14, wherein the at least one of the recess and the cavity includes the cavity;

the watercraft further comprising a bumper covering the lips of the hull and the deck; and wherein the bumper defines at least a portion of the cavity.

16. The watercraft of claim 12, wherein the mooring line assembly is a first mooring line assembly;

the watercraft further comprises a second mooring line assembly according to claim 1; and wherein the housing of the first mooring line assembly is disposed forward of the housing of the second mooring line assembly.

17. The watercraft of claim 16, wherein the first end of the elastic line of the first mooring assembly is connected to the housing of the second mooring line assembly; and wherein the first end of the elastic line of the second mooring assembly is connected to the housing of the first mooring line assembly.

18. The watercraft of claim 12, wherein the at least one of the recess and the cavity includes the cavity; and wherein the cavity is defined between the hull and the deck.

19. The watercraft of claim 18, wherein the mooring line assembly is a first mooring line assembly;

the watercraft further comprises a second mooring line assembly according to claim 1;

wherein the housing of the first mooring line assembly is disposed forward of the housing of the second mooring line assembly; and wherein, in the retracted positions of the mooring lines of the first and second mooring line assemblies, a part of the mooring line of the first mooring line assembly overlaps the elastic line of the second mooring line assembly, and the elastic line of the first mooring line assembly overlaps a part of the mooring line of the second mooring line assembly.

20. A mooring line assembly for a watercraft, the mooring line assembly comprising:

an elastic line having a first end and a second end, the first end of the elastic line being adapted for connection to the watercraft;

a mooring line having a first end and a second end, the first end of the mooring line being connected to the second end of the elastic line;

a housing adapted for connection to the watercraft, the mooring line extending through the housing, the mooring line being pullable through the housing from a retracted position to a plurality of extended positions; and a lock cooperating with the mooring line for locking the mooring line in any one of the plurality of extended positions, in the retracted position:

the elastic line has a first length, and a portion of the mooring line extending from the first end of the mooring line to the housing has a second length;

in any one of the plurality of extended positions:

the elastic line has a third length, the third length being greater than the first length, and the portion of the mooring line extending from the first end of the mooring line to the housing has a fourth length, the fourth length being less than the second length; and the elastic line being adapted for returning the mooring line to the retracted position from the plurality of extended positions.

* * * * *